US009821208B2

(12) United States Patent
Hall

(10) Patent No.: US 9,821,208 B2
(45) Date of Patent: Nov. 21, 2017

(54) MULTI-HEADED, MULTI-ABDOMEN, MULTI-ARMED APPARATUS FOR USE WITH A SLIP AND COUNTER FIGHT SIMULATION/WORKOUT MACHINE OR STAND ALONE DEVICE FOR FIGHT SIMULATION

(71) Applicant: Clarence V. Hall, Plainfield, NJ (US)

(72) Inventor: Clarence V. Hall, Plainfield, NJ (US)

( * ) Notice: Subject to any disclaimer, the term of this patent is extended or adjusted under 35 U.S.C. 154(b) by 443 days.

(21) Appl. No.: 13/999,772

(22) Filed: Mar. 20, 2014

(65) Prior Publication Data

US 2015/0265898 A1 Sep. 24, 2015

(51) Int. Cl.
*A63B 69/34* (2006.01)
*A63B 69/20* (2006.01)
(Continued)

(52) U.S. Cl.
CPC ..... *A63B 69/34* (2013.01); *A63B 21/008* (2013.01); *A63B 24/00* (2013.01); *A63B 69/201* (2013.01);
(Continued)

(58) Field of Classification Search
CPC ..... A63B 69/004; A63B 69/0051; A63B 69/0053; A63B 69/20; A63B 69/201; A63B 69/203; A63B 69/205; A63B 69/206; A63B 69/208; A63B 69/24; A63B 69/32; A63B 69/34; A63B 69/345; A63B 2069/0044; A63B 2244/10; A63B 2244/102; A63B 2244/104; A63B 2244/106;
(Continued)

(56) References Cited

U.S. PATENT DOCUMENTS 835,796 A 11/1906 Lindsley ..... 482/83
1,685,495 A * 9/1928 Latz ..... A63B 69/206 223/67
(Continued)

FOREIGN PATENT DOCUMENTS

EP 0557264 A2 8/1993 ..... A63B 69/34
WO WO 2012089194 7/2012 ..... A63B 69/201

OTHER PUBLICATIONS

Aaltazar. "Boxing Match between Human and Alien in Space." Gettyimages, Google image search limited by date before Mar. 20, 2014, www.gettyimages.com/detail/illustration/boxing-match-between-human-and-alien-in-royalty-free-illustration/479282979.*
(Continued)

*Primary Examiner* — Joshua Lee
(74) *Attorney, Agent, or Firm* — Ernest D. Buff, Esq.; Ernest D. Buff & Associates, LLC; Margarate A. LaGoix

(57) ABSTRACT

A fight simulation multi-headed, multi-abdomen, multi-armed apparatus is adapted to be used in conjunction with a slip and counter fight simulation apparatus or stand alone apparatus. The fight simulation multi-headed, multi-abdomen, multi-armed apparatus includes a multi-headed member having at least one head attached to at least one abdomen and at least one arm having a glove appending member. Preferably, multiple heads are attached to multiple abdomens with multiple arm pairs to provide different punch configurations for the user to strike at. The multi-headed, multi-abdomen, multi-armed provides various angles adapted for a user to punch, knee, and/or do a flying knee.

13 Claims, 30 Drawing Sheets

(51) Int. Cl.

| | |
|---|---|
| ***A63B 69/22*** | (2006.01) |
| ***A63B 69/24*** | (2006.01) |
| ***A63B 69/28*** | (2006.01) |
| ***A63B 69/30*** | (2006.01) |
| ***A63B 21/008*** | (2006.01) |
| ***A63B 24/00*** | (2006.01) |
| *A63B 69/00* | (2006.01) |
| *A63B 71/02* | (2006.01) |

(52) U.S. Cl.
CPC ..... *A63B 69/203* (2013.01); *A63B 69/206* (2013.01); *A63B 69/208* (2013.01); *A63B 69/004* (2013.01); *A63B 69/0053* (2013.01); *A63B 2071/025* (2013.01); *A63B 2071/026* (2013.01); *A63B 2210/50* (2013.01); *A63B 2220/801* (2013.01); *A63B 2220/803* (2013.01); *A63B 2225/09* (2013.01); *A63B 2225/093* (2013.01); *A63B 2225/10* (2013.01); *A63B 2244/102* (2013.01); *A63B 2244/106* (2013.01)

(58) Field of Classification Search
CPC . A63B 2244/108; A63B 21/008; A63B 24/00; A63B 2071/025–2071/026; A63B 2210/50; A63B 2220/801; A63B 2220/803; A63B 2225/09; A63B 2225/093; A63B 2225/10; A63B 2225/50
See application file for complete search history.

(56) References Cited

U.S. PATENT DOCUMENTS

| | | | | |
|---|---|---|---|---|
| 2,909,370 | A | 10/1959 | Fortney | 482/83 |
| 3,250,533 | A | 5/1966 | Nicholson | 482/83 |
| 3,804,406 | A * | 4/1974 | Viscione | A63B 69/004 273/454 |
| 4,088,315 | A * | 5/1978 | Schemmel | A63B 69/34 482/4 |
| 4,353,545 | A * | 10/1982 | Anderson | A63B 69/0053 273/440 |
| 4,434,980 | A * | 3/1984 | Babineaux | A63B 69/20 482/86 |
| 4,491,324 | A | 1/1985 | Yoshida | 463/8 |
| 4,593,900 | A * | 6/1986 | Burke | A63B 69/34 482/83 |
| 4,765,609 | A | 8/1988 | Wilson et al. | 482/83 |
| 4,819,934 | A | 4/1989 | Wilson et al. | 482/83 |
| 5,052,683 | A | 10/1991 | Wang et al. | 482/7 |
| 5,100,138 | A | 3/1992 | Wilde | 273/440.1 |
| 5,221,243 | A * | 6/1993 | Walker | A63B 69/0053 482/83 |
| 5,256,069 | A * | 10/1993 | Snowden, Jr. | A63B 69/34 434/247 |
| 5,281,191 | A | 1/1994 | De Sousa | 482/83 |
| 5,352,170 | A * | 10/1994 | Condo | A63B 69/201 482/83 |
| 5,419,749 | A | 5/1995 | Morgenstein | 482/99 |
| 5,613,925 | A * | 3/1997 | Miasserian | A63B 69/0053 482/83 |
| 5,700,230 | A * | 12/1997 | Cardona | A63B 69/34 482/83 |
| 5,735,775 | A | 4/1998 | Miasserian | 482/83 |
| 5,803,877 | A | 9/1998 | Franey | 482/83 |
| 5,888,152 | A * | 3/1999 | Rogers | A63B 69/345 473/440 |
| 6,063,011 | A * | 5/2000 | Pelchat | A63B 69/004 482/83 |
| 6,110,079 | A * | 8/2000 | Luedke | A63B 24/0062 446/268 |
| 6,152,863 | A * | 11/2000 | Nelson | A63B 69/004 482/83 |
| 6,165,068 | A | 12/2000 | Sonoda et al. | 463/8 |
| 6,336,891 | B1 | 1/2002 | Fedrigon et al. | 482/8 |
| 6,416,445 | B1 | 7/2002 | Nelson et al. | 482/83 |
| 6,432,027 | B1 * | 8/2002 | Haselrig | A63B 69/201 482/83 |
| 6,685,581 | B2 | 2/2004 | Krause et al. | 473/445 |
| 6,896,630 | B1 | 5/2005 | Breining | 473/422 |
| 6,994,349 | B2 * | 2/2006 | Lambert | F41J 7/04 273/392 |
| 7,041,039 | B2 | 5/2006 | Wang et al. | 482/87 |
| 7,329,210 | B1 * | 2/2008 | Marano | A63B 69/004 482/83 |
| 7,371,164 | B2 | 5/2008 | Ueshima | 463/8 |
| 7,678,028 | B1 * | 3/2010 | Gore | A63B 69/004 482/86 |
| 7,789,810 | B2 | 9/2010 | Le | 482/83 |
| 7,828,701 | B1 * | 11/2010 | Chen | A63B 69/004 482/83 |
| 7,862,485 | B2 * | 1/2011 | Luigi | A63B 69/004 482/83 |
| 7,998,035 | B2 * | 8/2011 | Chen | A63B 69/208 482/83 |
| 8,025,612 | B1 | 9/2011 | Buzzanco et al. | 482/83 |
| 8,079,938 | B2 | 12/2011 | Jones et al. | 482/8 |
| 8,298,124 | B2 * | 10/2012 | Brenner | A63B 69/34 482/83 |
| 8,348,815 | B2 * | 1/2013 | Signorino | A63B 69/20 482/4 |
| 8,617,034 | B2 * | 12/2013 | Eem | A63B 69/203 482/83 |
| 8,777,818 | B1 * | 7/2014 | Tate, Jr. | A63B 69/004 482/83 |
| 2002/0193211 | A1 * | 12/2002 | Kao | A63B 69/34 482/83 |
| 2003/0073548 | A1 * | 4/2003 | Haselrig | A63B 69/201 482/83 |
| 2003/0125168 | A1 * | 7/2003 | Hackaday | A63B 69/206 482/89 |
| 2004/0248633 | A1 * | 12/2004 | Trawick | A63B 69/34 463/8 |
| 2006/0252608 | A1 | 11/2006 | Kang et al. | 482/84 |
| 2006/0258515 | A1 | 11/2006 | Kang et al. | 482/83 |
| 2007/0183829 | A1 * | 8/2007 | Dickson | A63B 69/004 400/273 |
| 2008/0008984 | A1 * | 1/2008 | McDonald | A63B 69/004 434/247 |
| 2008/0076636 | A1 * | 3/2008 | Smith | A63B 69/004 482/1 |
| 2009/0264264 | A1 * | 10/2009 | Reen | A63B 69/004 482/86 |
| 2010/0179031 | A1 | 7/2010 | Luigi | 482/89 |
| 2011/0059827 | A1 * | 3/2011 | Fazio | A63B 69/34 482/83 |
| 2011/0067521 | A1 | 3/2011 | Linn et al. | 74/490.06 |
| 2011/0264266 | A1 | 10/2011 | Kock | 700/253 |
| 2011/0295399 | A1 | 12/2011 | Plociennik et al. | 700/97 |
| 2012/0065032 | A1 * | 3/2012 | Jang | A63B 24/0062 482/83 |
| 2012/0108394 | A1 | 5/2012 | Jones et al. | 482/8 |
| 2012/0214648 | A1 * | 8/2012 | Schlicher | A63B 69/203 482/87 |
| 2012/0252637 | A1 * | 10/2012 | Pellot | A63B 69/20 482/89 |
| 2013/0065731 | A1 | 3/2013 | Jones et al. | 482/8 |
| 2014/0039680 | A1 | 2/2014 | Angie et al. | 700/259 |
| 2015/0018174 | A1 * | 1/2015 | Partlo | A63B 69/201 482/87 |

OTHER PUBLICATIONS

"Cardio Exercise Equipment" found at http://www.dailymotion.com/video/xc2rtn_cardio-exercise-equipment-cardio-bo_sport.
"Don King Boxing game Wii" found at http://www.gamespot.com/wii/sports/don-king-boxing/index.html.

* cited by examiner

Right Uppercut Arm

MULTI-HEADED, MULTI-ABDOMEN, MULTI-ARMED APPARATUS FOR USE WITH A SLIP AND COUNTER FIGHT SIMULATION/WORKOUT MACHINE OR STAND ALONE DEVICE FOR FIGHT SIMULATION

This is a Continuation-In-Part of U.S. application Ser. No. U.S. Ser. No. 13/781,594, filed Feb. 28, 2013 for "Slip And Counter Fight Simulation/Workout Machine" which, in turn, is a Continuation-In-Part of U.S. application Ser. No. 13/385,703, filed Mar. 2, 2012 for "Slip And Counter Fight Simulation/Workout Machine", the disclosures of which are hereby incorporated in their entirety by reference thereto.

BACKGROUND OF THE INVENTION

1. Field of the Invention

The present invention relates to sports training devices; and, more particularly, to a slip and counter fight simulation and workout machine that promotes physical fitness, and provides fight training and/or fight simulations.

2. Description of the Prior Art

Boxing, fighting and karate arts involve martial training for sport, self-defense, and/or physical fitness. Kick-boxing and boxing have gained more popularity in the past several years owing to physical fitness and weight loss benefits imparted through the discipline. Increasingly, people of all ages are discovering the benefits derived from boxing or fighting, or self-defense training when developing self protection skills.

Often in sports training, exercising and self-defense instruction for an individual utilizes a punching bag or the like to practice punching and/or kicking. However, in this manner the individual is generally the sole participant and does not have to return punches or kicks. Although the use of a punching bag or punching device provides a good work-out, the device does not provide any skill teaching methods for knocking-out an adversary, or for dodging or defending against punches or kicks.

Another form of training in sport boxing, exercising and/or self-defense instruction involves a close contact sport wherein two individuals in a ring participate in a sparring match. While highly effective, there can be problems with finding a sparring partner and particularly, finding a sparring partner having a complementing skill level. Moreover, the actual person to person contact can sometime result in injuries.

Various devices have been heretofore disclosed and utilized for providing fight/boxing training and/or workouts. A number of devices generally include a boxing dummy, full body devices simulating a person, or sparing device, wherein a right and left arm with gloves are extended from a torso and some sort of mechanism is provided so that the arms move outwardly and upwardly if at all. Generally, only two arms are provided. As a result the mechanism can only deliver a very limited type of punch and punching range. Even where more than one type of arm is provided, the arms have a very limited range of motion and cannot be adjusted to accommodate specific needs of a plethora of individuals.

There remains a need in the art for an exercise apparatus that incorporates boxing and kick-boxing fitness features, and comprises a plurality of moving arms spaced at intervals that deliver different punches and/or defensive moves. Further, there exists a need in the art for an exercise fight simulation apparatus that can be adjusted to meet specific training and fitness needs of each individual.

SUMMARY OF THE INVENTION

The present invention is directed to a multi-headed, multi-abdomen, multi-armed member for use with a slip and counter fight simulation/workout machine or stand alone device for fight simulation. The fight simulation multi-headed, multi-abdomen, multi-armed apparatus includes a multi-headed member having at least one head, at least one abdomen and at least two pairs of arm, optionally having a glove appending member. Preferably, multiple heads are attached to multiple abdomens with multiple arm pairs to provide different punch configurations including hook punches, straight punches or uppercuts and uppercut type punches. The multi-headed, multi-abdomen, multi-armed apparatus provides various angles adapted for a user to punch.

The slip and counter machine comprises a fight simulation apparatus that incorporates boxing and kick-boxing fitness features. A plurality of moving arms spaced at intervals deliver different punches and/or defensive moves. The slip and counter machine incorporates a fight simulation apparatus that is readily adjusted to meet specific training and fitness needs of each individual. Usage of the fight simulation apparatus spans substantially the entire range from novice to pro; is particularly well suited for educating, training and/or challenging users. Specific applications also include assisting individuals during training for self-defense, so that the trainee becomes empowered to protect himself/herself.

The fight simulation/workout machine includes a) at least two side walls, b) each side wall including at least one, preferably at least two, height-adjustable arms traversing slots, c) a glove appendage member being located on a proximate end of each of said arms, d) at least one counter area/counter element, and e) the arms being located on the side walls and arranged in a manner as to provide different punch configurations, including hook punches, straight punches or uppercuts and uppercut type punches, respectively. Further embodiments of the fight simulation/workout machine include the construction of the glove appendage member that is removable and composed of different grade materials/softness (i.e. pillow soft, soft, medium); configuration of the arms: with a first and third arm including an elbow joint, and the second/middle arm being straight; configuration of the counter area/element, and preferably presentation of at least two counter areas/elements, including a head counter area/element and a mid/stomach counter area/element; and specific elements concerning the control and activation of the machine (i.e. sensor, on/off switch, and the like).

In one embodiment a fight simulation workout machine is provided comprising at least two substantially parallel opposing side walls wherein each side wall including at least one, preferably at least two, height-adjustable arms that traverse separate slots and are substantially parallel to one another. A glove appendage member located on a proximate end of each of the arms is also provided. At least one counter area/element constructed as a multi-head member having at least two head portions each having a face is provided. Most preferably, there are at least eight heads. Wherein the arms provide different punch configurations including hook punches, straight punches or uppercuts and uppercut type punches, respectively. Further, wherein the multi-head member provides various prospective adapted for a user to punch.

In another embodiment a free standing flight simulation workout machine is provided. The free standing flight simulation workout machine comprises: a. a main support structure including a mounting loop thereon for attaching a first s-hook thereto, the first s-hook further being connected to a first cord; b. at least one counter area/element including a top having a u-shaped loop thereon for receiving a second s-shaped hook adapted to be attached to the first cord; c. the at least one counter area/element including a bottom having a u-shaped loop thereon for receiving a third s-shaped hook adapted to be attached to a second cord, the second cord having a fourth s-shaped hook attached on an opposite end thereof; and d. a base portion, wherein the base portion includes a base loop that removably connects to the fourth s-shaped hook. Preferably, the counter area/element is shaped as a head, more preferably being a multi-head member having at least two heads; and most preferably being a multi-head member having eight heads, further comprising an abdomen portion with at least two pairs of arms extending therefrom. Preferably, there are at least eight pairs of arms, yielding a total of sixteen arms. The apparatus may further include elongated necks with heads and/or arms protruding therefrom. Preferably a mid counter area/element is also provided, optionally including a multi-stomach mid counter area/element, which preferably includes at least four stomach portions forming a four sided portly stomach.

In another embodiment, the fight simulation multi-headed, multi-abdomen, multi-armed apparatus is utilized with a free standing flight simulation workout machine. The free standing flight simulation workout machine includes a height adjustable stand main support structure including a mounting loop thereon for attaching a first s-hook thereto, the first s-hook further being connected to a first cord. At least one counter area/element is provided including a top having a u-shaped loop thereon for receiving a second s-shaped hook adapted to be attached to the first cord. The at least one counter area/element includes a bottom having a u-shaped loop thereon for receiving a third s-shaped hook adapted to be attached to a second cord, the second cord having a fourth s-shaped hook attached on an opposite end thereof. A base portion is provided wherein the base portion includes a base loop that removably connects to the fourth s-shaped hook.

A method of using a fight simulation multi-headed, multi-abdomen, multi-armed apparatus with workout machine is provided. The method comprises the steps of: 1) selecting at least one multi-headed, multi-abdomen, multi-armed apparatus, the apparatus comprising: a. a multi-headed member having at least one head, at least one abdomen, and at least two pairs of arms (totaling at least four arms); wherein the head(s) and arms provide different punch configurations including hook punches, straight punches or uppercuts and uppercut type punches, respectively, for the user to practice; and wherein the multi-head member provides various angles adapted for a user to punch; 2) determining a height of a user who is adapted to use the workout machine, the machine comprising: a. at least two substantially parallel opposing side walls; b. each side wall including at least one height-adjustable arm that traverse separate slots and are substantially parallel to one another; c. a glove appendage member located on a proximate end of each of the arms; and d. at least one counter area/element; wherein the arms provide different punch configurations including hook punches, straight punches or uppercuts and uppercut type punches, respectively; 3) adjusting heights of the arms in relation to the height of the user; 4) adjusting length and angels of the arms in relation to the height of the user; 5) activating the machine into an on/off position; and 6) delivering punches of varying types to the user based on the arms.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1A:
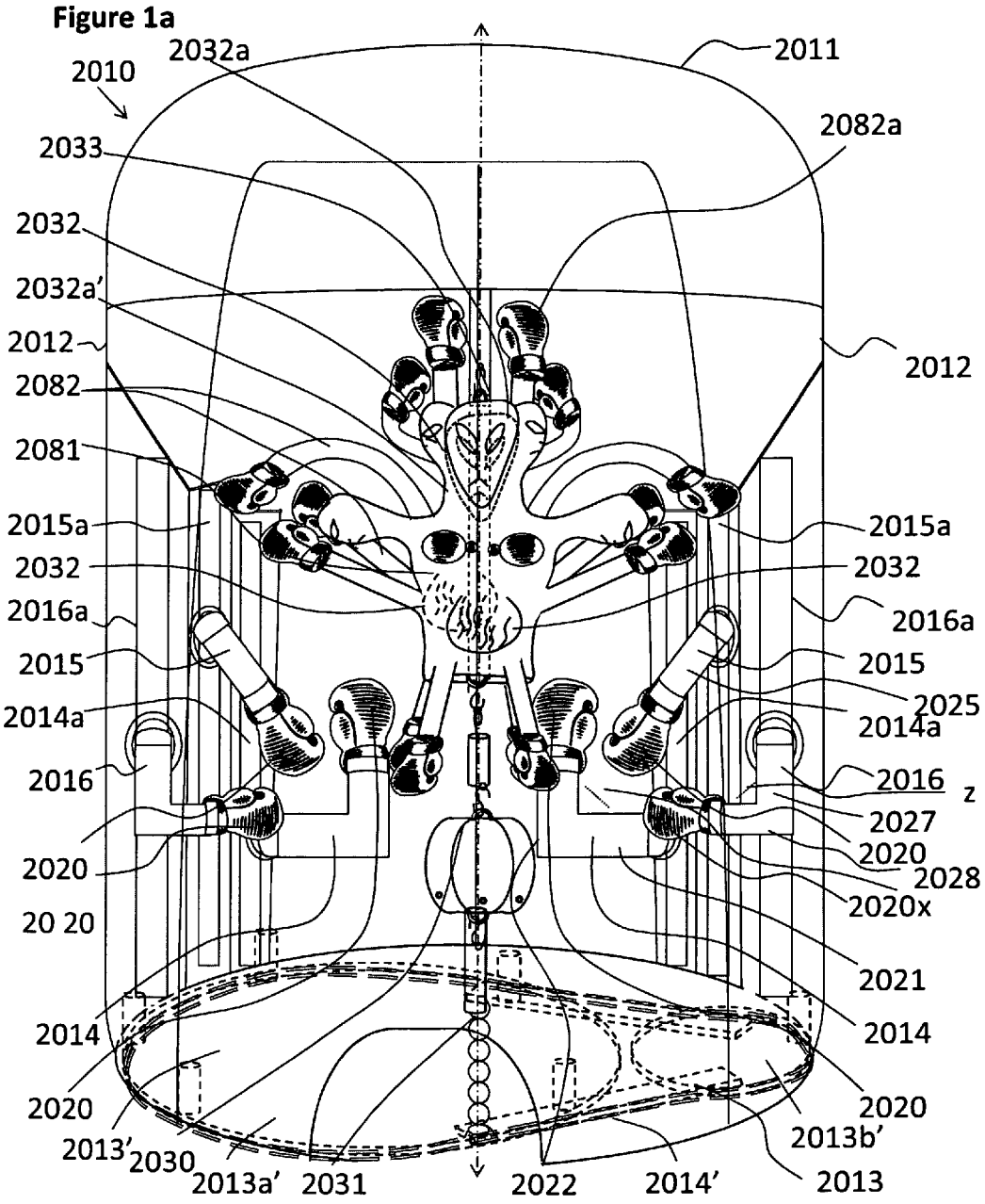
FIG. 1*a* illustrates a perspective view of an embodiment of the fight simulation apparatus of the subject invention.

The present invention is directed to a multi-headed, multi-abdomen, multi-armed member for use with a slip and counter fight simulation/workout machine or stand alone device for fight simulation. The fight simulation multi-headed, multi-abdomen, multi-armed apparatus includes a multi-headed member having at least one head, at least one abdomen and at least two pair of arms each preferably having a glove appending member. Preferably, multiple heads are attached to multiple abdomens with multiple arm pairs to provide different punch configurations including hook punches, straight punches or uppercuts and uppercut type punches. The multi-headed, multi-abdomen, multi-armed apparatus provides various angles adapted for a user to punch, or knee strike around, over and/or under the apparatus. The fight simulation multi-headed, multi-abdomen, multi-armed apparatus may be configured so that one side of the apparatus has different arm orientations, height placement, arm length, etc, so that varying moves are required by the user for advanced training. For example, on one side of the apparatus hook arms may be located higher than hook arms on another side of the apparatus, which hook arms may be located higher. In addition, arms can vary in length, be; shorter or angled to protect the abdomen of the apparatus. Also, the; heads can be adjusted, placed and/or angled at varying heights, locations and angles.

The multi-member apparatus provides a main center/abdomen area for a user to knee, punch, etc. Between, around, over, under arms are positioned near chins located on heads of the apparatus, coming from heads (preferably of aliens for example) and also coming out of necks in straight, overhand, and/or hooked positions.

The present invention is directed to a multi-headed, multi-abdomen, multi-armed member for use with a slip and counter fight simulation/workout machine or stand alone device for fight simulation; is adapted to be used in physical fitness, fight training and/or fight simulations. Generally stated, the slip and counter fight simulation/workout machine provides a plurality of movable arms that move in a random or programmable fashion, directing jabs, hooks and upper-cut punches at an individual. The slip and counter machine incorporates a fight simulation/workout machine that includes at least two side walls. Each side wall includes at least one height-adjustable arm, preferably at least two arms, traversing slots. At least two or three of the arms of the slip and counter machine can come towards a user simulating a person being jumped or ganged-up on by more than one person so that the user can practice a fight simulation where the user is being ganged-up on by more than one person. A glove appendage member is located on a proximate end of each of the arms. Preferably the base of the slip and counter machine moves in intervals of 12 seconds, 10 seconds, 7 seconds, 3 seconds, etc.

The machine includes at least one counter area/element. The arms are located on the side walls and arranged in a manner that provides different punch configurations, including hook punches, straight punches or uppercuts and uppercut type punches, respectively. Further embodiments of the fight simulation/workout machine concern the construction of the glove appendage member. In these embodiments, the glove appendage member is removable and composed of different grade materials/softness (i.e. pillow soft, soft, medium). Other embodiments involve the configuration of the arms: with a first and third arm including an elbow joint, and the second/middle arm being straight. Further embodiments involve the configuration of the counter area/element, and the presence of at least two counter areas/elements, one of which comprises a head counter area and another of which comprises a mid/stomach counter area. Still other embodiments involve specific elements concerning the control and activation of the machine (i.e. sensor, on/off switch, and the like).

The multi-headed, multi-armed, multi-abdomen, preferably alien faced apparatus is comprised of a plethora of heads and arms strategically placed in various angles and are structured to provide a use with the ability to practice different punch moves. As the apparatus is hit, it shifts or rotates to expose an abutting side of the apparatus, which preferably has different arm configurations and multiple arms and heads configurations for the user to strike. The subject multi-headed, multi-armed, multi-abdomen device attaches to flexible poles and cords to simulate the potentially rapid movements of an actual physical altercation. Multi-heads are angled in positions from upright tall to low, facing towards the ground and various positions in between, with at least one of the necks preferably being elongated. Arms are arranged to extend from or come out of the abdomen, heads and necks of the apparatus, and are arranged in overhand, straight and hook punch positions, with the arms or fists (of each of the arms) being beside chins of each of the heads. Preferably, the apparatus is designed to look like a forward facing alien, looking mean and unhappy with a downward frowning mouth and big eyes, preferably black and glossy eyes and grey, brownish or greenish skin. The subject device is adapted to help the user learn how to hit a moving head at different angles while simultaneously the device has some of the gloved hands protecting the chins of the apparatus. Arms extend out from the necks and heads of the apparatus, with the arms being positioned in a combination of positions, including hooking positions, overhand positions, straight out positions, one pointing upward position and one pointing downward, all for a user to learn how to go under arms, over, in between etc. utilizing knees, kicks, and punches. Each side of the device poses a different challenge.

The apparatus originally stands as the counter part of a slip and counter machine. However, the apparatus can be attached to either a height adjustable pole stand with s hooks and bungee cords and threaded u adapters that unscrews so that parts of the apparatus can be used with a different type of stand if required. The height adjustable pole stand includes a base with a threaded hole either on it or in it for a flexible spring pole to be screwed into. The other end of the pole in turn screws into the bottom of the abdomen of the multi-headed device. The multi-headed device can also work on a stand that utilizes one or two flexible spring poles, one pole if the user would like to use just one part of the multi-headed device, either the lower or the upper part. Where both the upper and lower part of the multi-headed device is intended to be used, two poles would be needed. The upper flexible pole has a strong spring usually in the middle of the pole, and the pole is threaded at both ends to go into the bottom of the upper striking part while the other end screws into the top of the lower striking part of the multi-headed device. The second lower pole is preferably not as flexible and is preferably thicker and stronger, so that the mid-section part of the multi-headed device doesn't move as much. The second lower pole is threaded on one side only, to screw into the bottom of the mid-section of the multi-headed device. The other end of the second pole has height adjustable holes and slides into a water or sand filled base having height adjustable holes along with a tightening knob.

In another embodiment, the multi-headed device is adapted to be attached to chains and hung on a traditional punching bag stand. Punching bag stands are preferably sold separately. The multi-headed device slip and counter machine preferably is constructed preferably having six height adjustable arms that have separate slots and at least two side walls. Preferably, the multi-headed device has at least two pairs of arms—with at least one for each side wall where the apparatus is a four sided construct/with at least two on each side wall where the apparatus is a two sided construct. The hook and uppercut arms of the multi-headed device preferably have elbow joints, in order to practice fighting very close. The multi-headed device further preferably comprises straight arms angled downward or upward. When the multi-headed device/apparatus is placed within the slip and counter machine as discussed herein, the slip and counter machine arms are arranged so that two or three arms simultaneously come toward the user to simulate fighting against more than one person at the same time. Preferably the slip and counter machine moves in random, unpredictable directions and at different times. For example after 10 seconds the entire slip and counter machine will move and at times after three seconds or seven seconds, etc., the slip and counter machine will again move. The multi-headed apparatus sits within the center of the slip and counter machine. Movement of the slip and counter machine is preferably, at various speeds. Proximity sensors are provided at different areas, like at the wrist, etc., for safety reasons.

In one embodiment, movement of the subject device is achieved by the way of at least two wheels located underneath the base of the device. One wheel is preferably larger than the other wheel. At least six prongs are located on the wheels: three on each side of the top half of the wheel and three prongs on the bottom of the second half. A durable high strength belt surrounds the two wheels, causing them to move by an electric motor. Preferably, the arms of the device operate similarly, via wheel pulley structure or by pneumatics, linear actuators, hydraulics or the like.

The multi apparatus in the center of the Slip and Counter machine preferably comes with a plethora of interchangeable parts. Due to some users just beginning, or even being elderly, etc., one may want to work their way up from using one head and one mid-section, portly or muscular (optional) and eventually change out the singular head and utilize a four sided head that will have two of the heads facing downwards, similar to the eight multi-headed apparatus but without sixteen arms to focus on which will be harder to time the movement and strike accurately. It may require lots of confidence to start out with an eight headed sixteen armed apparatus, and therefore a novice user has the ability want to focus on using just the four sided abdomen alone. Interchangeability of the different members of the device takes seconds. Pillow soft gloved shaped washable cushions optionally come with the apparatus so that a user has the ability to place cushions over some of the protruding arms.

The present invention advantageously incorporates a plurality of heads hooked between two bungee cords to provide various heads for numerous positions, strikes, timing, speed and accuracy. Preferably there are at least two heads, more preferably there are at least four heads, and most preferably there are at least eight heads. Additionally, the present invention further preferably provides at least a two sided portly stomach. Most preferably, a four sided portly stomach is provided. In this manner, as opposed to striking just one stomach hooked on to one end of a bungee cord, the user can strike various stomachs. Directly on the top center of the four sided portly stomachs there is a u-shaped loop for an s-hook to hook onto. The other side of the s-hook connects to a bungee cord that similarly hooks onto the bottom of the multi headed apparatus, meaning via an s-hook hooked onto a u-shaped loop connected to the bottom of the multi headed apparatus. This multi headed apparatus most preferably has a total of eight faces and five heads. The head at the very top includes four faces on one head, similar to the four sided stomach member. The side of each face on the four sided head preferably terminate or stop right before where an ear would appear, such as on a typical human head, so that the side of each head can be hit. Consequently, there will be no ears or back of head on the four face head portion of the multi headed member. Likewise concerning the multi stomach member, preferably each stomach will have each side exposed for side hits, but no backs will be exposed or provided. The top center of the four sided head member of the multi headed member includes a u-shaped loop connected to an s-hook that connects to a bungee cord. The other end of the bungee cord in turn connects to a hook preferably located in the top or ceiling of the slip and counter apparatus. Connected to the bottom of the neck of the four faced head of the multi headed member are four additional heads with one face each, but these heads are faced in an angle a little higher than facing towards the ground, and the necks are somewhat long. The angle of these heads preferably ranges from 30 degrees to 80 degrees in relation to the horizontal plane or ground surface. More preferably, the angle ranges from 35 degrees to 55 degrees. Most preferably, the angle is about 45 degrees.

Additionally, at least two sets of arms are provided. Most preferably four sets of arms are provided. The hands of the arms are preferably in the form of boxing gloves. Heads are located on the front and back of the multi-headed apparatus/member—wherein there is at least a two headed configuration. Preferably, the heads on the front and back of the multi-headed member are set extremely low on the apparatus so that the heads can be used for knee strikes. Preferably, at least one arm associated with at least one of the heads (front and/or back) is positioned as if it is ready to pick-up a person, like a wrestler, and with Mixed Martial Arts (MMA) style gloves on as opposed to other arms with boxing gloves on as hands. One set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. The multi headed member may be constructed as one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member. Further, the single head and/or single stomach construction, as described in U.S. application Ser. No. 13/385,703 filed Mar. 2, 2012, the disclosure of which is hereby incorporated in its entirety by reference thereto, can be interchanged out from the multi headed and multi stomach members of the subject invention.

Advantageously, as constructed, the subject apparatus enhances the ability for the user to practice his/her uppers cuts and knee strikes. Further, as constructed, a user can also walk into the slip and counter apparatus and warm up and build confidence by practicing with the stationary arms of the multi headed member, prior to exercising with the moving arms of the apparatus as a whole, and warm-up punching between, around, under, over arms. Each side of the multi-member apparatus is preferably different, so that the arms/necks/heads are placed at different locations, heights, angles so that the apparatus can be unhooked and turned on the other side for varying the work-out or fight simulation.

In one embodiment a fight simulation workout machine is provided comprising at least two substantially parallel opposing side walls wherein each side wall including at least one height-adjustable arm that traverse separate slots and are substantially parallel to one another. A glove appendage member located on a proximate end of each of the arms is also provided. At least one counter area/element constructed as a multi-head member having at least two head portions each having a face is provided. The multi apparatus can work with any type of face or head or, even pads instead, but most preferably alien faced heads. These heads will be in all positions from upright to facing the ground, for knee strikes. To be more versatile, the apparatus comes with interchangeable parts, single head, single abdomen portly/muscular, a four sided head, a four sided abdomen, and four sided cross shaped pads, all interchangeable. Most preferably, there are at least eight heads. Wherein the arms provide different punch configurations including hook punches, straight punches or uppercuts and uppercut type punches, respectively. Further, wherein the multi-head member provides various prospective adapted for a user to punch.

In another embodiment a free standing flight simulation workout machine is provided. The free standing flight simulation workout machine comprises: a. a main support structure including a mounting loop thereon for attaching a first s-hook thereto, the first s-hook further being connected to a first cord; b. at least one counter area/element including a top having a u-shaped loop thereon for receiving a second s-shaped hook adapted to be attached to the first cord; c. the at least one counter area/element including a bottom having a u-shaped loop thereon for receiving a third s-shaped hook adapted to be attached to a second cord, the second cord having a fourth s-shaped hook attached on an opposite end thereof; and d. a base portion, wherein the base portion includes a base loop that removably connects to the fourth s-shaped hook. Preferably, the counter area/element is shaped as a head, more preferably being a multi-head member having at least two heads; and most preferably being a multi-head member having eight heads, further comprising at least two to eight pairs of arms extending from the apparatus—extending from heads, necks, and/or an abdominal area. Preferably a mid counter area/element is also provided, optionally including a multi-stomach mid counter area/element, which preferably includes at least four stomach portions forming a four sided portly stomach.

The slip and counter fight simulation/workout machine is ideally suited for installation in a gym, workout center, private home, and/or game room. It contains a number of arms that move in random fashion, directing jabs, hooks and upper-cut punches at an individual ("User") that stands between the moving arms. The machine can operated at a slow speed for training purposes; at a medium speed as training progresses; or at a higher speed for skilled individuals that wish to perfect and maintain their skills.

Figure 1B:
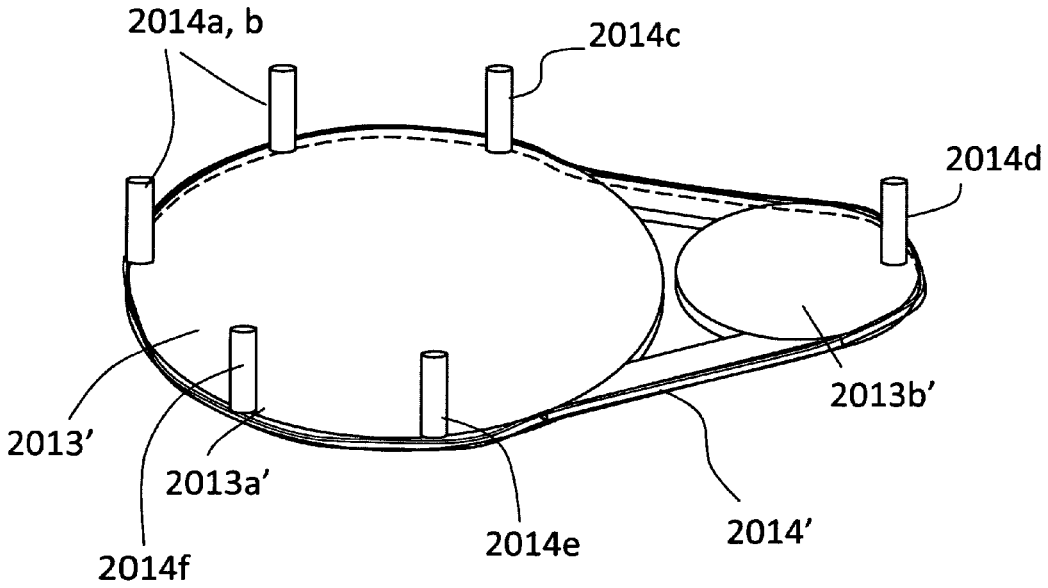
FIG. 1*b* illustrates a perspective view of an embodiment of the movement driver of the subject fight simulation apparatus of FIG. 1*a;*
Figure 1C:
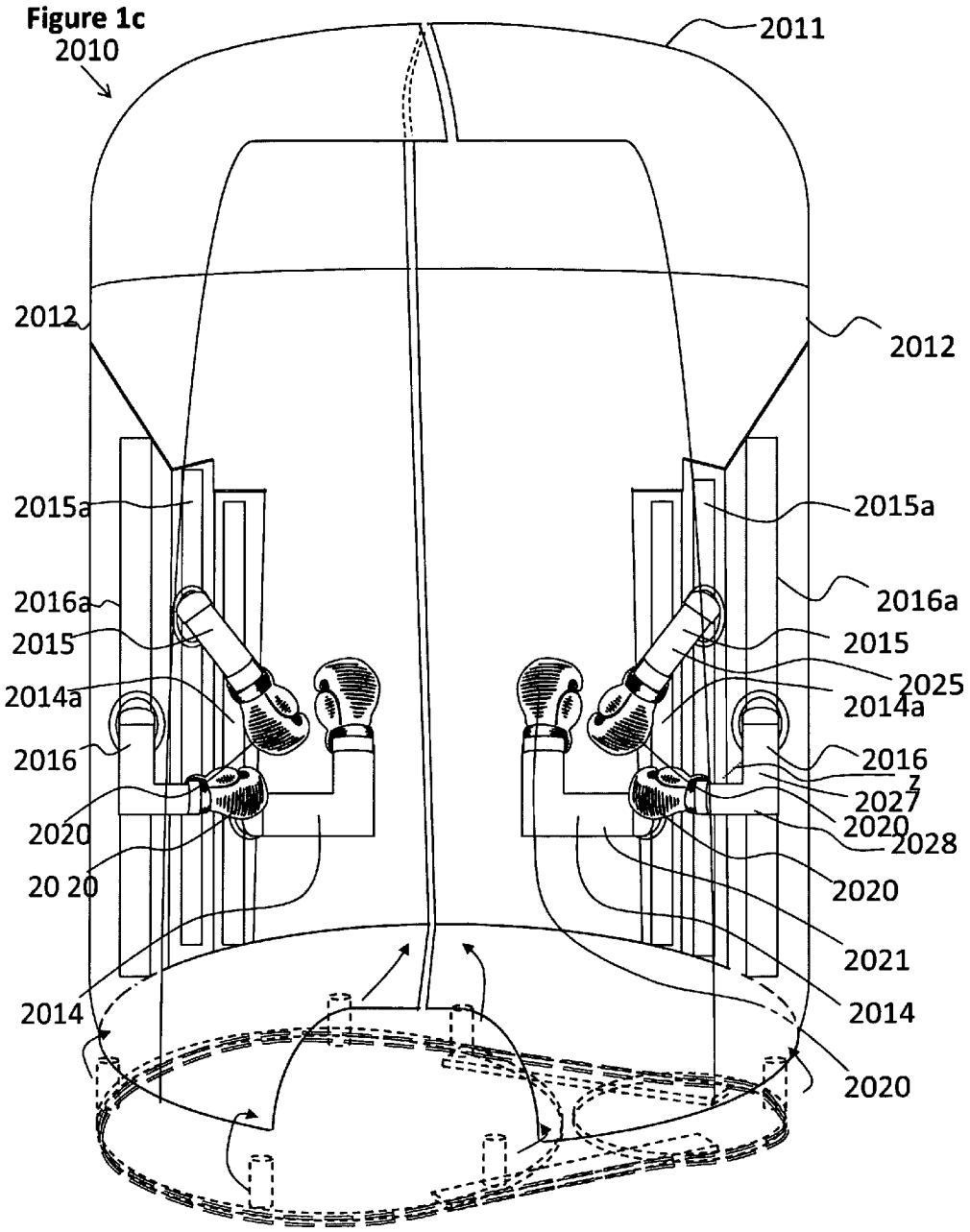
FIG. 1*c* illustrates a perspective view of the embodiment of the movement driver of the subject fight simulation apparatus of FIG. 1*a* as arranged under the fight simulation apparatus/device with the multi-head, multi-abdomen, and multi-arm apparatus removed therefrom.
Figure 1D:
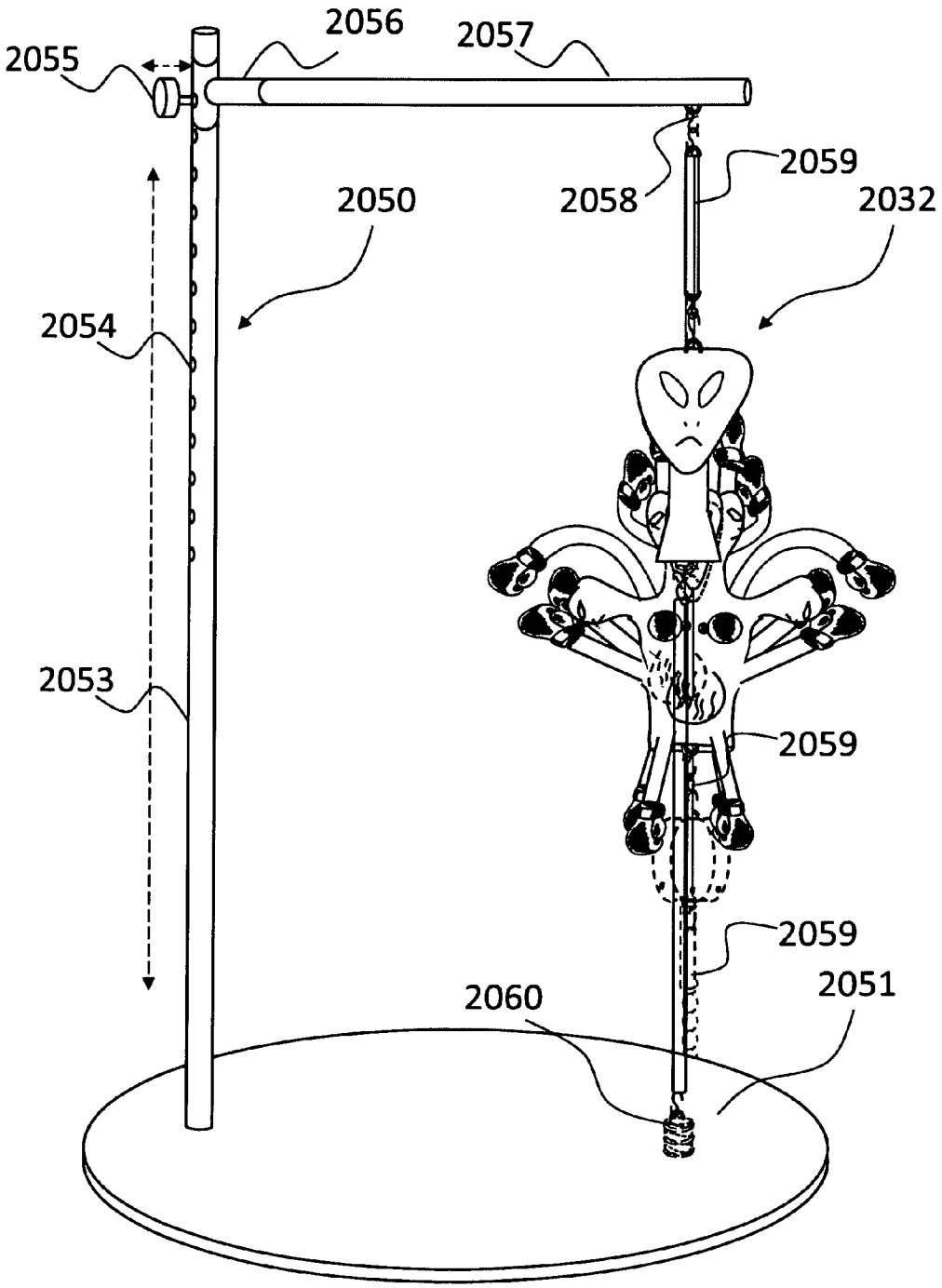
FIG. 1*d* illustrates a perspective view of the embodiment of the fight simulation apparatus of the subject invention where the multi-head, multi-abdomen, and multi-arm apparatus is removed from the slip and counter machine and placed on a free standing apparatus as a punching bag type structure (for example)

FIGS. 1*a*-1*c* illustrates perspective views of the subject flight simulation apparatus and interchangeable elements thereof. FIG. 1*a* illustrates a perspective view of an embodiment of the fight simulation apparatus of the subject invention. FIG. 1*b* illustrates a perspective view of an embodiment of the movement driver of the subject fight simulation apparatus of FIG. 1*a*. FIG. 1*c* illustrates a perspective view of the embodiment of the movement driver of the subject fight simulation apparatus of FIG. 1*a* as arranged under the fight simulation apparatus/device. FIG. 1*d* illustrates a perspective view of the embodiment of the fight simulation apparatus of the subject invention where the multi-head, multi-abdomen, and multi-arm apparatus is removed from the slip and counter machine and placed on a free standing apparatus as a punching bag type structure (for example).

Referring to FIGS. 1*a*-1*c*, the multi-headed, multi-abdomen, multi-armed member shown at 2032 is shown used with a slip and counter fight simulation/workout machine at 2010. Workout machine 2010 generally includes a U-Shaped construct having a top wall 2011, at least two parallel side walls 2012 arranged opposite from one another, and may optionally include a bottom floor mat 2013 located on a base 2013'. Preferably, there is no bottom floor mat. As used herein, the term "U-Shaped" is meant to be a ground view of the device 2010 as one stands directly in front of the device 2010. In this manner, a user is appointed to walk into the U-shape between the side walls 2012 and is thus substantially surrounded by the device. That is to say, the user's front, and sides are in proximity with the side walls 2012 of the device as the user walks inside the U-shape; providing a device 2010 having side walls 2012 forming an arc ranging from about 90 degrees up to about 270 degrees. Preferably, the side walls 2012 are arced or curved and form a semi-circle of about 180 degrees. In this manner, fight simulation is optimized to substantially surround a user who walks into the U-shaped device (sides and front of user).

If a bottom floor mat 2013 is provided, it may include a sensor therein for activating or turning on the machine 2010. Alternatively, the device may be constructed without a bottom floor mat 2013 and instead there may simply be a sensor beam located near the bottom of one or more of the side walls 2012, or top wall 2011. Within side walls 2012 there are a series of arms 2014, 2015, 2016 extended within first, second and third slots 2014*a*, 2015*a*, 2016*a*, respectively, that allow the arms to adjust height wise from the floor mat 1013, on a substantially vertical plane. The slots 2014*a*, 2015*a*, 2016*a* or tracks are located substantially parallel to one another and are substantially perpendicular to the bottom floor mat 2013. Preferably there are three arms 2014, 2015, 2016 as shown, each located in separate slots 2014*a*, 2015*a*, 2016*a* and each being capable of being adjusted along the vertical plane extending from the floor/ground level/or bottom floor mat 2013. Each of the arms 2014, 2015, 2016 are spaced and constructed to deliver different punch types/provide different extension ranges for delivery of different punches, as discussed hereinafter.

Base 2013' is preferably constructed to provide movement of the device achieved by the way of at least two wheels 2013*a*' and 2013*b*' located underneath the base 2013'. Wheel 2013*a*' is preferably larger in diameter than the wheel 2013*b*'. (see FIG. 1*b*). At least six prongs 2014*a*-2013*f* are located on the wheels 2013*a*' and 2013*b*': three on each side of the top half of the wheels 2013*a*' and 2013*b*' and three prongs on the bottom of the second half. A durable high strength belt 2014' surrounds the wheels 2013*a*' and 2013*b*', causing them to move by an electric motor. Preferably, the arms of the device operate similarly, via wheel pulley structure or by pneumatics, linear actuators, hydraulics and the like.

The multi apparatus preferably includes some arms coming out of the elongated necks of aliens and arms out of the alien heads, arms in all positions like overhand, coming straight out, or hook positions. Preferably eight heads and sixteen arms are provided. Mixed Martial Arts (MMA) style gloves, boxing gloves or pads can be arranged on the ends of the arms. Some arms will be positioned so that the gloved hands would be located next to the chin of heads. The multi-member apparatus can work in the center of the slip and counter machine, which includes a moving base, two side walls, and at least two arms as shown in FIG. 1*a*. Alternatively, all parts of the multi-member apparatus can also work with the height adjustable stand of FIG. 1*d*, consisting of bungee cords, S hooks, flexible spring pole with thread at both ends, and threaded U adapter to screw into the base of stand.

The arms 2014, 2015 and 2016 are provided within slots 2014*a*, 2015*a*, 2016*a* so that the arms 2014, 2015, 2016 vertically traverse the slots 2014*a*, 2015*a*, 2016*a* to accommodate users of varying heights. The arms and slots may include tongue and groove mating means, with teeth and mating slots. Alternatively, hydraulics and/or electronics may be used for movement of the arms 2014, 2015, 2016 along slots 2014*a*, 2015*a*, and 2016*a*.

Each of the arms 2014, 2015, 2016 includes a glove appendage member 2020 thereon. Preferably, glove appendage members 2020 are removable and different grade glove members 2020 are provided, including pillow soft, soft, medium, hard.

Figure 5:
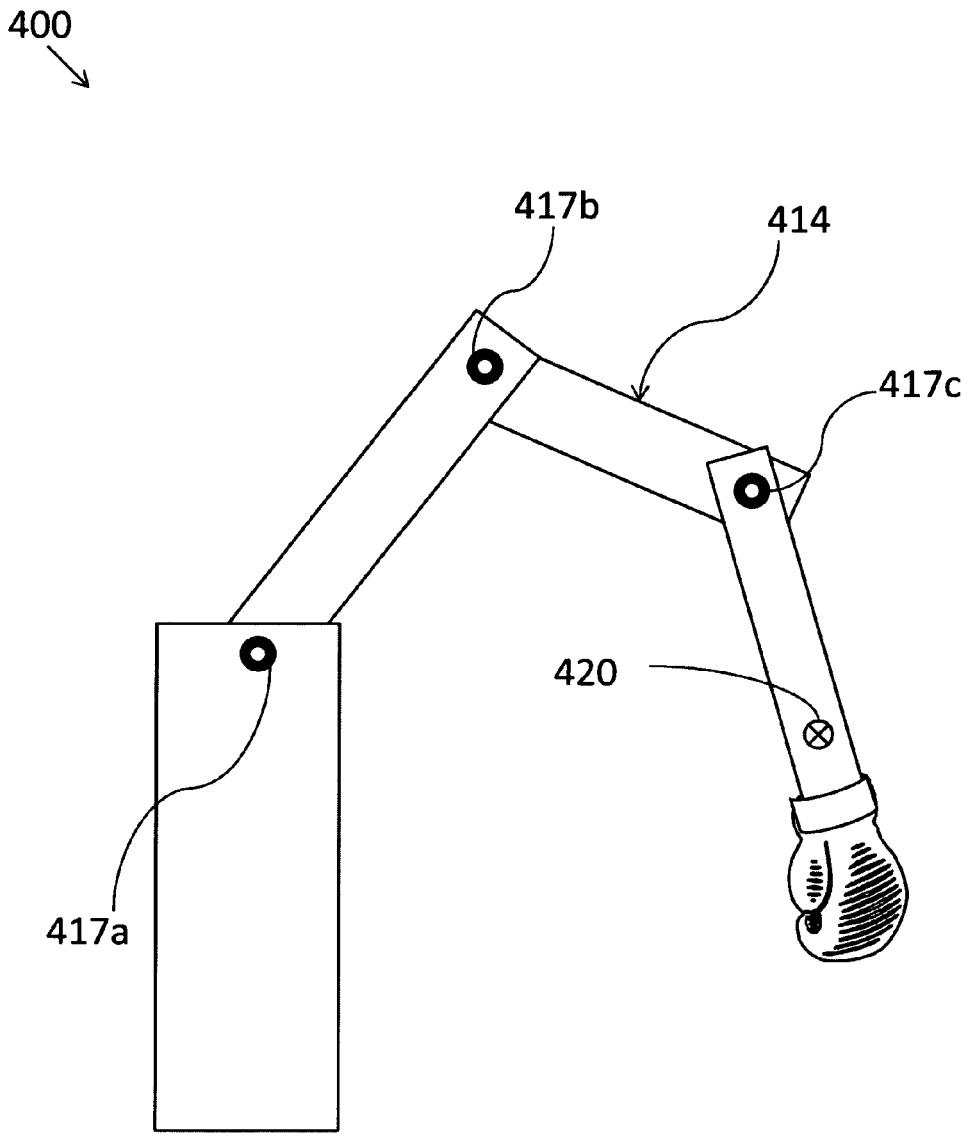
FIG. 5 illustrates a view of a left hook arm, showing flexible joints.

Arm 2014 includes at least on elbow joint connecting an upper arm portion 2021 and a lower arm portion 2022 and provides an angle x located there between. FIG. 5 illustrates arm jointed configurations. Arm 2014 is appointed to deliver uppercut type punches. Arm 2016, like arm 2014, includes an elbow joint connecting an upper arm segment 2027 and a lower arm segment 2028 and provides an angle z located there between. Arm 2016 is appointed to deliver hook type punches. Advantageously, the purpose for the elbow joints on the hook arms 2016 are for tighter hooks, in case a user prefers fighting up close. The purpose for the elbow joints on the uppercut arms 2014 is so the half uppercut-half hook punch can be thrown.

In contrast, arms 2015, located centrally between arms 2014 and 2016, and are preferably constructed on as straight members 2025 that are angled downward (or upward) from side walls 2012. Preferably, arms 2015 slant or angle toward the center of the device 2010 and said angle is adjustable as illustrated by way of FIG. 4. As so constructed, arm 2015 delivers straight punches. Preferably, arms 2015 are provided as telescoping arms as shown in FIGS. 2 and 3.

Continuing with FIGS. 1*a* and 1*b*, counter areas/elements are provided, generally including a mid/stomach section counter area/element 2030 having a strong cable 2031 or bungee cord, and a counter area/element shown as a multi headed member 2032. Cable 2031 may be composed of a flexible material so that the cable 2031 gives a little to avoid hurting the user's wrists; alternatively, cable 2031 may be composed of a rigid material but in such an event cable 2031 has some slack in order to give so it won't hurt the user's wrists. The counter areas are to be positioned in the back and center of the machine, the same way a user's body would be behind his/her arms in the fighting position.

Each of the counter elements, herein 2030 and 2032, are interchangeable, including use of the different punch-able members that can be interchanged on the apparatus, including showing the multi-headed member, a single head member, a single stomach member, the multi-stomach member, the 4-sided cross pad and 4-sided alien head. These members are shown for example in FIG. 2*c*.

A multi-headed, multi-abdomen, multi-armed apparatus/member 2032 is provided having at least one head, one abdomen and one arm—preferably, multiple heads (or pad portions if not shaped like heads) abdomens 2081 and arms 2082 (2082*a*-*n*) are provided. One set of arms, shown generally at 2082*a*, is shown extending preferably from the back of a head 2032*a*. Heads are located on the front and back of the multi-headed apparatus/member—wherein there is at least a two headed configuration. Preferably, the heads on the front and back of the multi-headed member are set extremely low on the apparatus so that the heads can be used for knee strikes. Preferably, at least one arm associated with at least one of the heads (front and/or back) is positioned as if it is ready to pick-up a person, like a wrestler, and with Mixed Martial Arts (MMA) style gloves on as opposed to other arms with boxing gloves on as hands. It is noted that arms 2082*a-n* can have configurations that are arranged differently from one another so that the arms 2082*a-n* provide different arrangements for the user to punch. Arms 2082*a-n* are arranged to extend from or come out of the abdomen, chest, head, and/or neck of the apparatus and are preferably arranged in overhead, straight and/or hook positions. In the embodiment shown eight heads 2032*a-h*, each with alien faces thereon are provided. Note that the heads can have a plethora of different faces and may be arranged on elongated necks 2032*a-h*'. The heads 2032*a-h* may merely simply be appendages/pads having no face configuration. The top portion 2032' of the multi headed member 2032 is constructed having four heads 2032*a-d* interconnected to one another. Directly on the top center there is a u-shaped loop 2032" for an s-hook 2033 to hook onto. Top portion 2032' extends to an abdomen which in turn includes four more heads 2032*e-h* (heads 2032*f* and 2032*h* are shown as back of heads inasmuch as they are angled downward at an angle). These heads 2032*e-h* are faced in an angle a little higher than facing towards the ground, and the necks are somewhat long. The angle of these heads 2032*e-h* preferably ranges from 30 degrees to 80 degrees in relation to the horizontal plane or ground surface. More preferably, the angle ranges from 35 degrees to 55 degrees. Most preferably, the angle is about 45 degrees. The plurality of heads provides various heads for numerous positions, strikes, timing, speed and accuracy. Preferably there are at least two heads, more preferably there are at least four heads, and most preferably there are at least eight heads (as shown). [see FIG. 2*c* for more embodiments]. This multi headed apparatus most preferably has a total of eight faces and five heads. The side of each face on the four sided head preferably terminate or stop right before where an ear would appear, such as on a typical human head, so that the side of each head can be hit. Consequently, there will be no ears or back of head on the four face head portion of the multi headed member.

In the embodiment shown, and referring to FIG. 1*a*, a multi stomach member 2030 is provided having four stomachs 2030*a-d*. In this manner, as opposed to striking just one stomach hooked on to one end of a bungee cord, the user can strike various stomachs. Directly on the top center of the four sided portly stomachs there is a u-shaped loop 2080 for an s-hook 2022 to hook onto. Likewise concerning the multi stomach member, preferably each stomach will have each side exposed for side hits, but no backs will be exposed or provided.

Additionally, at least two sets of arms 2090 are provided. Most preferably four sets of arms are provided, 2090*a-d*. The hands of the arms are preferably in the form of boxing gloves. On set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. Preferably, there is a space of ranging from about 4 inches to about 8 inches.

The multi headed member may be constructed as one mold or more than one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The machine is preferably constructed having a U-shaped or arc-shaped construction. The uppercut slot 2014*a* for the uppercut arm 2014 is located the furthest away from the user and the closest arms towards the back of the device 2010, close to the counter areas/elements. The second or middle slot 2015*a* is appointed to deliver straight punches via the straight arm 2015. The third slot 2016*a* is for holding hook arm 2016 and for thus delivering deliver hook type punches. The straight arms 2015/second slot 2015*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 2013. The slots 2014*a*, 2015*a*, 2016*a* are designed to have the capability to make the arms 2014, 2015, 2016 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (2015) can be adjusted down low and slant in an upward position, for a taller person to practice fighting a shorter person. Also, preferably the hook arms and the uppercut arms (2016, 2014, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. What is more, the machine control pad includes different speeds and user levels, including slow, fast, faster, pro speeds; and/or levels of beginner, intermediate, or advanced.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 1*d* illustrates a perspective view of the embodiment of the fight simulation apparatus of the subject invention where the multi-head, multi-abdomen, and multi-arm apparatus 2032 is removed from the slip and counter machine and placed on a free standing apparatus 2050 as a punching bag type structure (for example). Preferably, the fee standing apparatus 2050 includes a water filled base 2051. The slip counter is shown in phantom to illustrate that the multi-head, multi-abdomen, and multi-arm apparatus 2032 may be placed on the device alone to provide a punching bag type configuration.

Figure 1E:
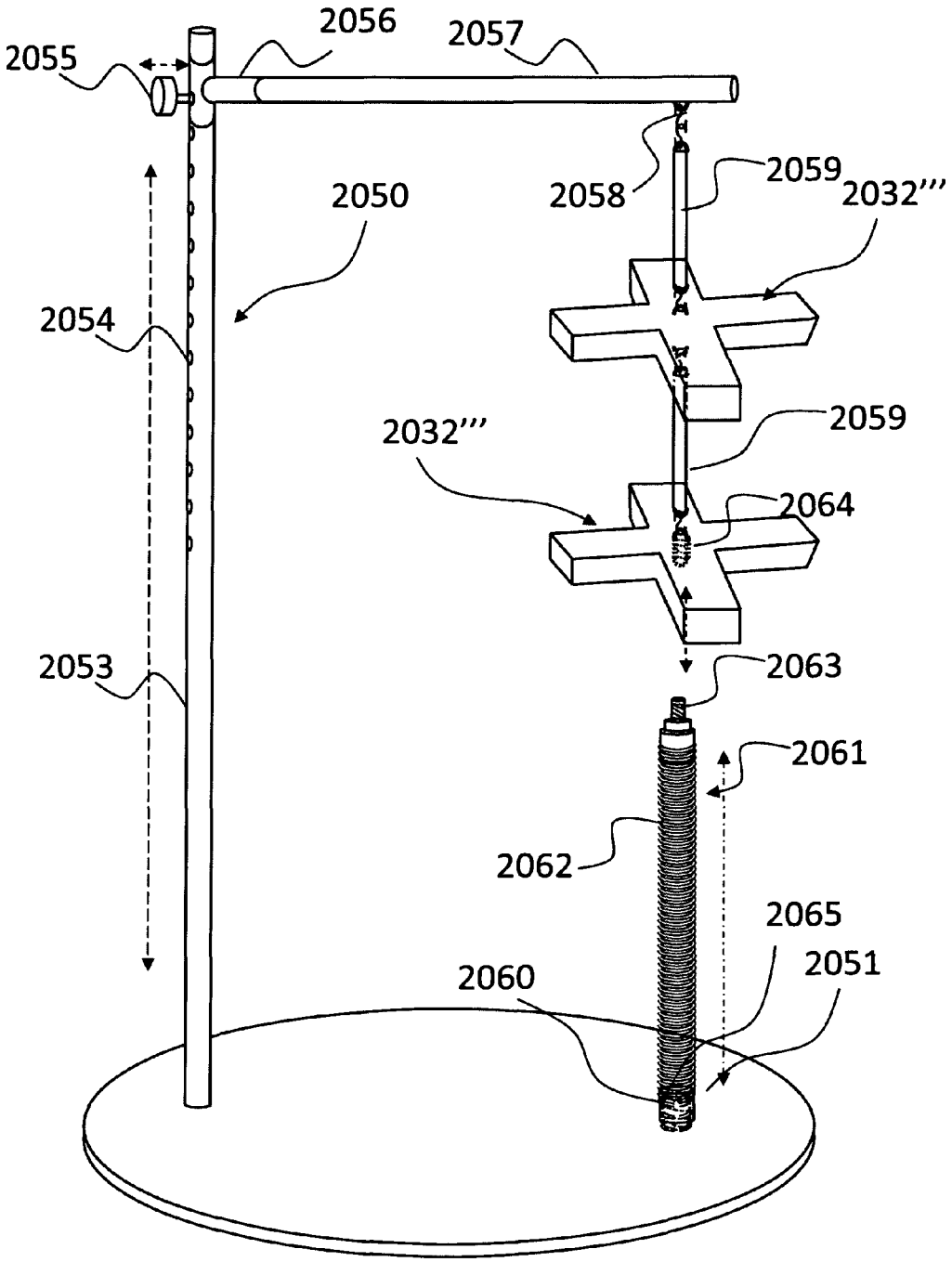
FIG. 1*e* illustrates a perspective view of the embodiment of the fight simulation apparatus of FIG. 1*d* wherein the multi-head, multi-abdomen, and multi-arm apparatus is removed from the free standing apparatus and interchanged with 4-sided cross-shaped head pads (for example)

FIG. 1*e* illustrates a perspective view of the embodiment of the fight simulation apparatus of FIG. 1*d* wherein the multi-head, multi-abdomen, and multi-arm apparatus 2032 is removed from the free standing apparatus 2050 and interchanged with 4-sided cross-shaped head pads 2032' (for example). Additionally, FIG. 12 illustrates a perspective view of the embodiment of the fight simulation apparatus of the subject invention where a multi-head apparatus being a single head interchangeable part 2032' is removed from the slip and counter machine and placed on the adjustable free standing apparatus 2050.

Figure 12:
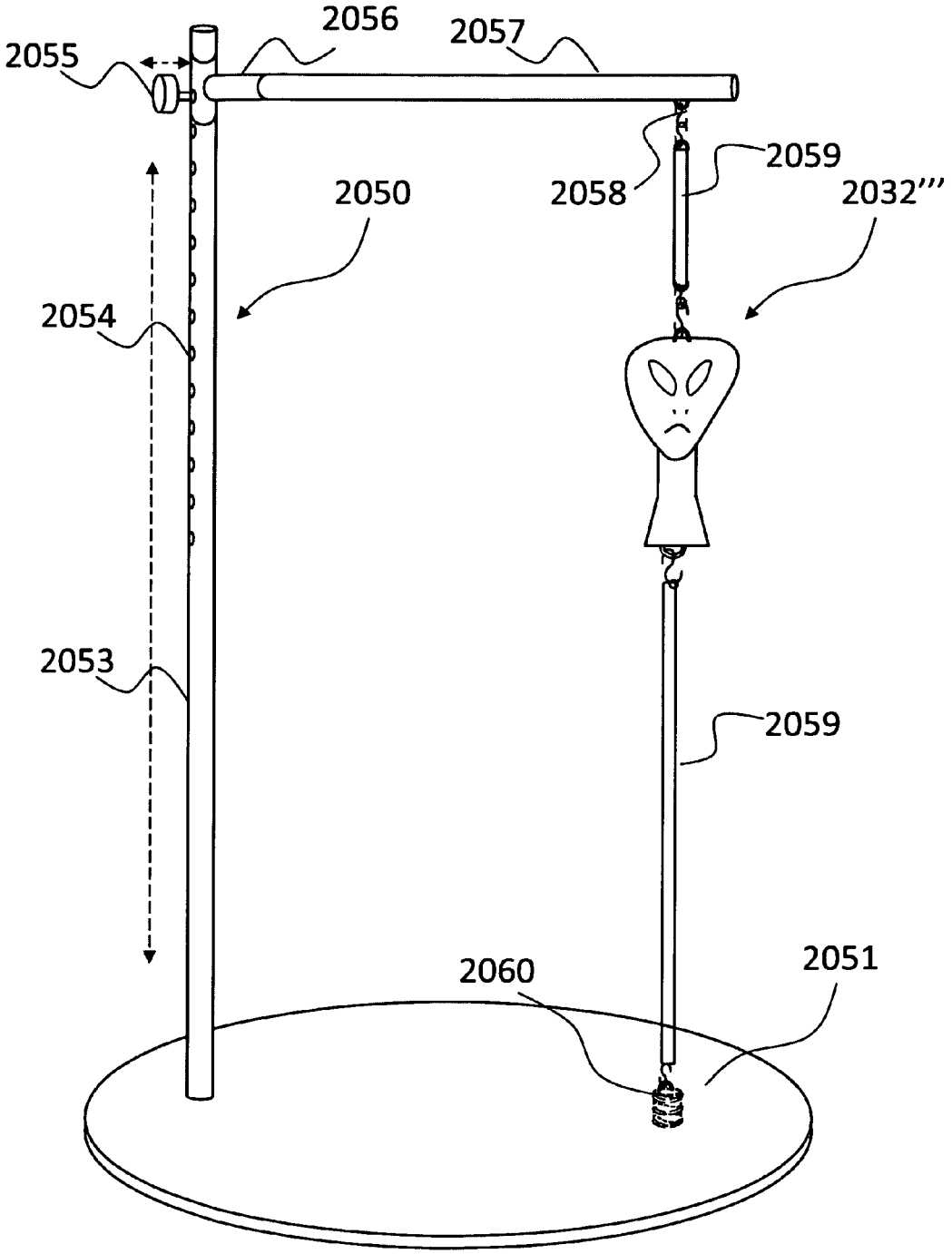
FIG. 12 illustrates a perspective view of the embodiment of the fight simulation apparatus of the subject invention where a multi-head apparatus being a single head interchangeable part is removed from the slip and counter machine and placed on an adjustable free standing apparatus as a punching bag type structure (for example)

Referring to FIGS. 1*d*, 1*e*, and 12 generally, the adjustable free standing apparatus 2050 includes a support pole 2053 having height adjustable apertures 2054 adapted to receive a pin 2055 that locks into place a t-bar connector 2056 having a horizontal support pole 2057 extending therefrom. In turn, horizontal support pole 2057 include attachment means (i.e. a hook) 2058 for securing an apparatus thereto. The apparatus may be bungee cords or flexible elastomeric cords 2059 which in turn connect to the interchangeable member, 2032, 2032' or 2032''' in FIGS. 1*d*, 1*e* and 12, respectively. At the base 2051 a connection means 2060 is provided which in turn may be a threaded connector that is adapted to attach to an insert pole 2061 as shown in FIG. 1*e*. Insert pole 2061 includes a strong flexible spring 2062 in the middle of the pole 2061, and has a threaded top 2063 to screw into the bottom of the abdomen of 2032 (or into the bottom of 2032' or 2032'', etc.) which in turn has a threaded aperture 2064 therein. The bottom of the pole 2061 includes a threaded aperture 2065 therein for receiving the threaded connector of connection means 2060. Height adjustable holes/adjustable apertures 2054 are located at the bottom of the support pole 2053 along with a tightening knob or pin 2055. If the free standing device 2050 is being utilized in conjunction with the slip and counter machine of FIG. 1 (for example) doors may be provided in the back of slip and counter machine of FIGS. 1*a* and 1*c*, located behind each side wall, so that the user would have access to changing the height of the arms. Once a user is done training on one side of the multi apparatus, he/she can simply unhook and spin the multi apparatus around in the Slip & Counter and proceed to use the other side. The multi-member apparatus allows two or three arms to come toward a user simultaneously along with at least one arm in at least one side wall on each side.

Figure 1F:
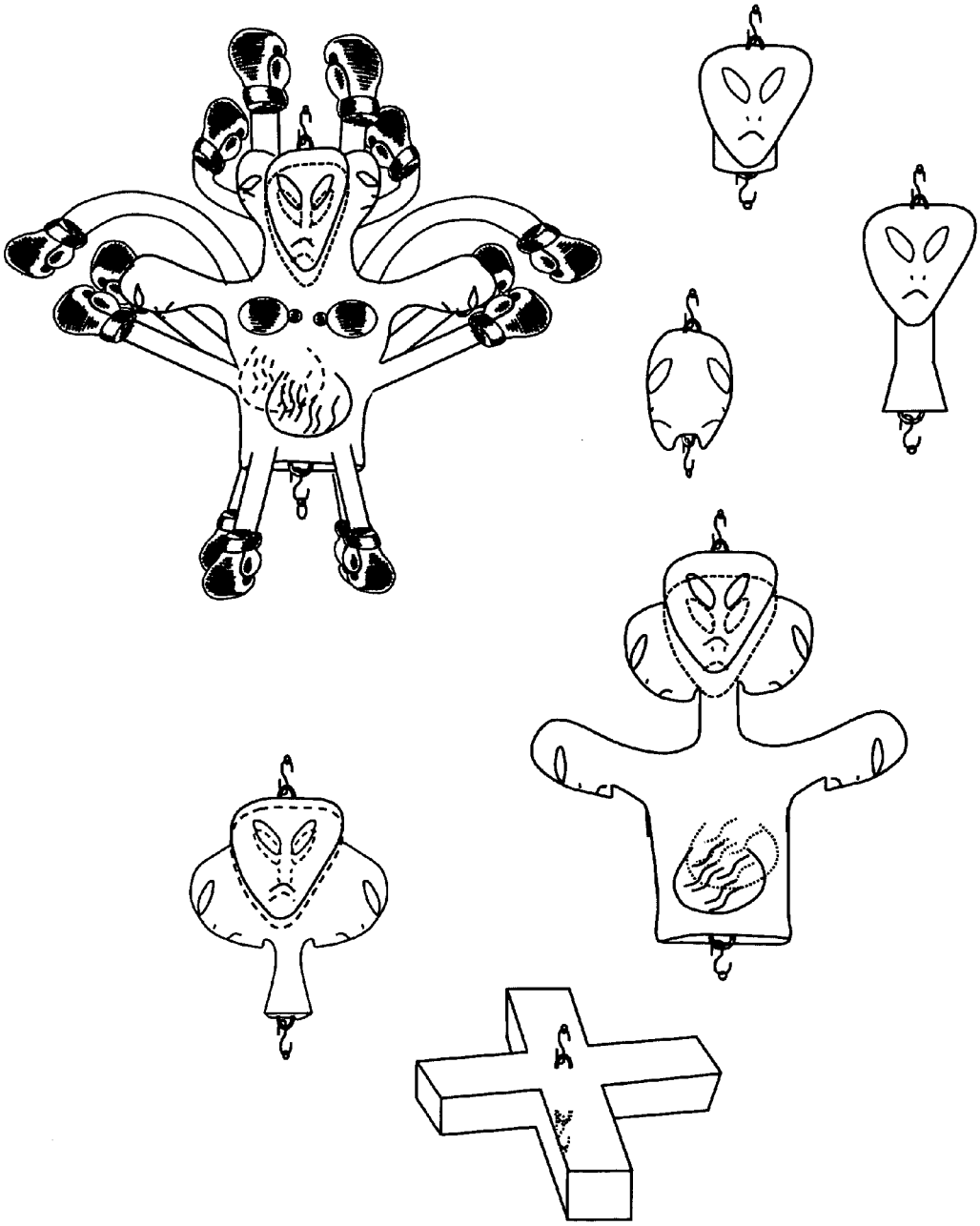
FIG. 1*f* illustrates views of the different punch-able members that can be interchanged on the apparatus, including showing the multi-headed member, a single head member, a single stomach member, and the multi-stomach member.

FIG. 1*f* illustrates views of the different punch-able members that can be interchanged on the apparatus, including showing the multi-headed member, a single head member, a single stomach member, a single headed alien, four-headed alien, the multi-stomach member, 4-sided cross-shaped head pads, etc.

Figure 1G:
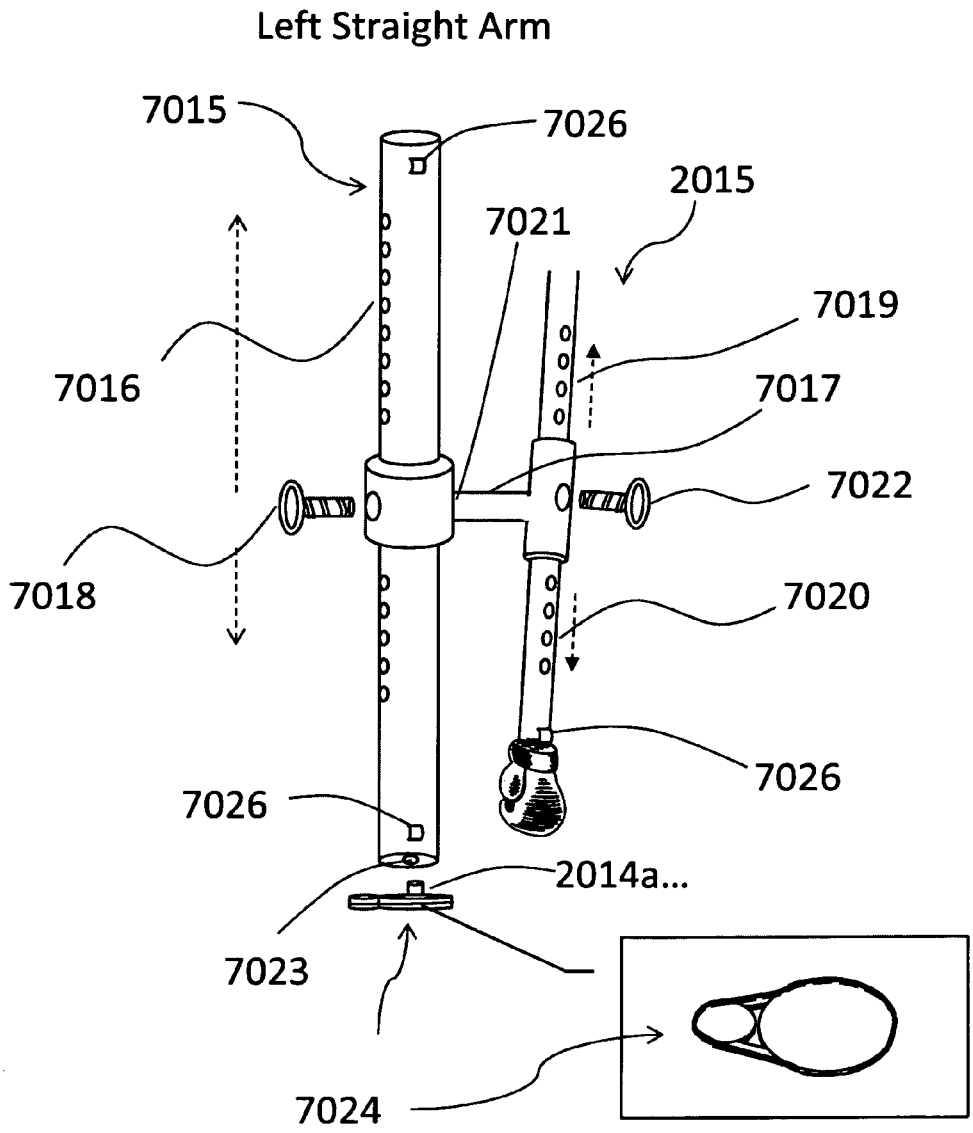
FIG. 1*g* illustrates views of the movable left straight arm configuration of the slip and counter machine of FIG. 1*a;*
Figure 1H:
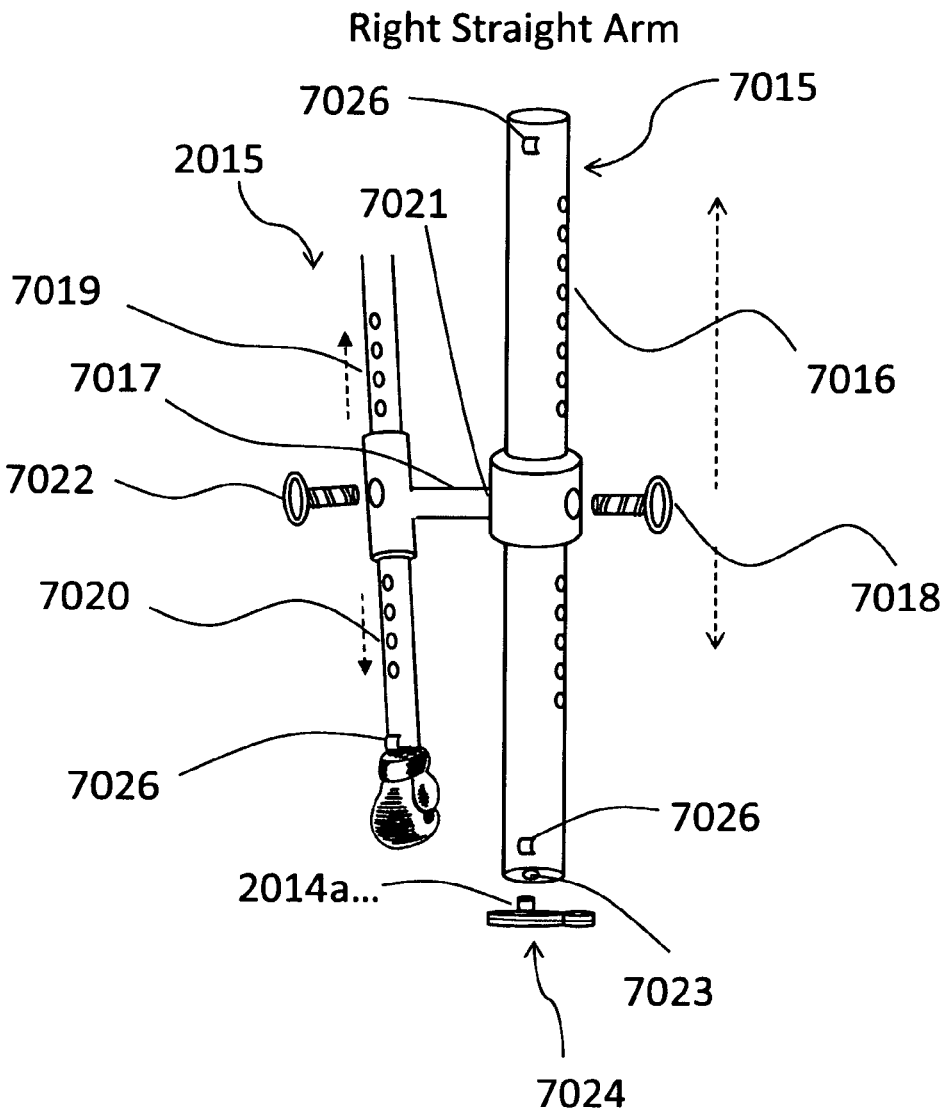
FIG. 1*h* illustrates views of the movable right straight arm configuration of the slip and counter machine of FIG. 1*a;*
Figure 1I:
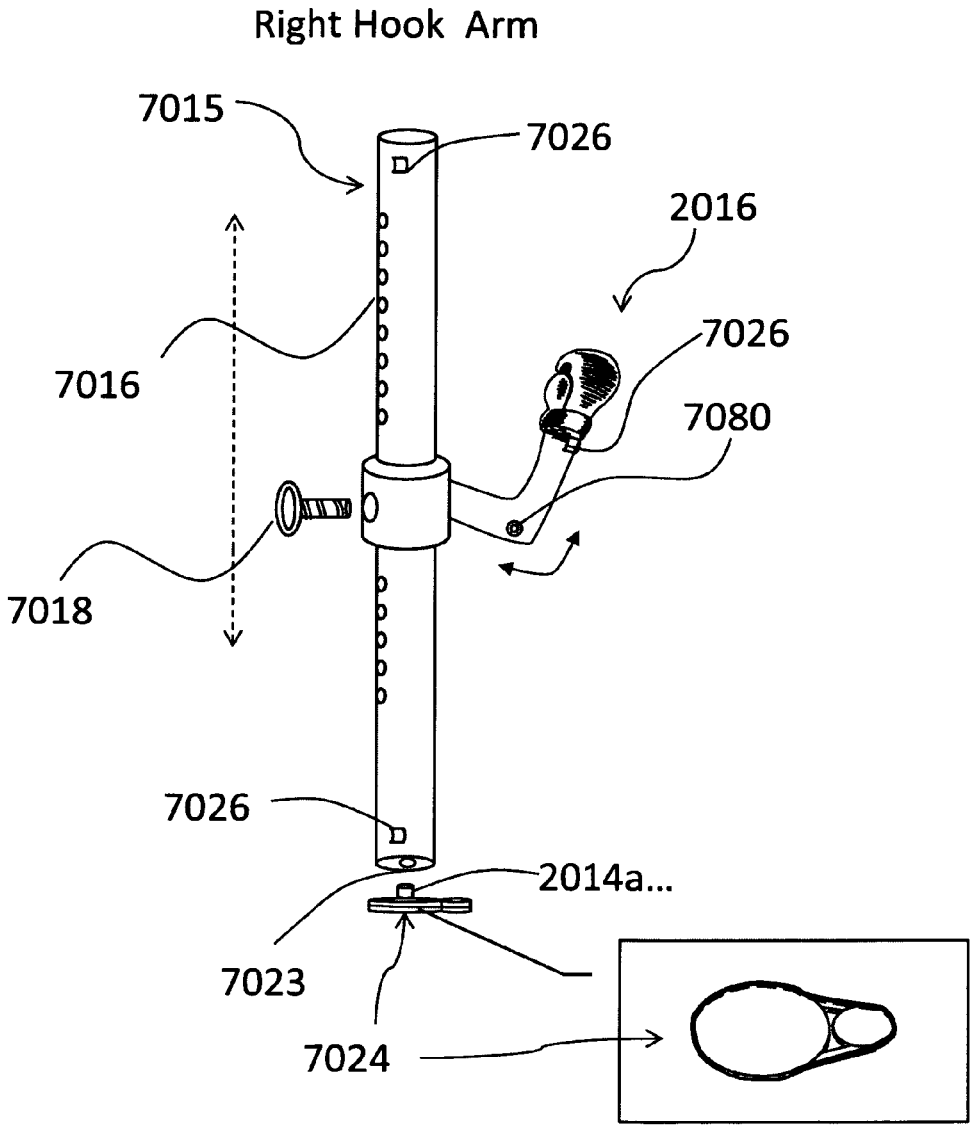
FIG. 1*i* illustrates views of the movable right hook arm configuration of the slip and counter machine of FIG. 1*a;*
Figure 1J:
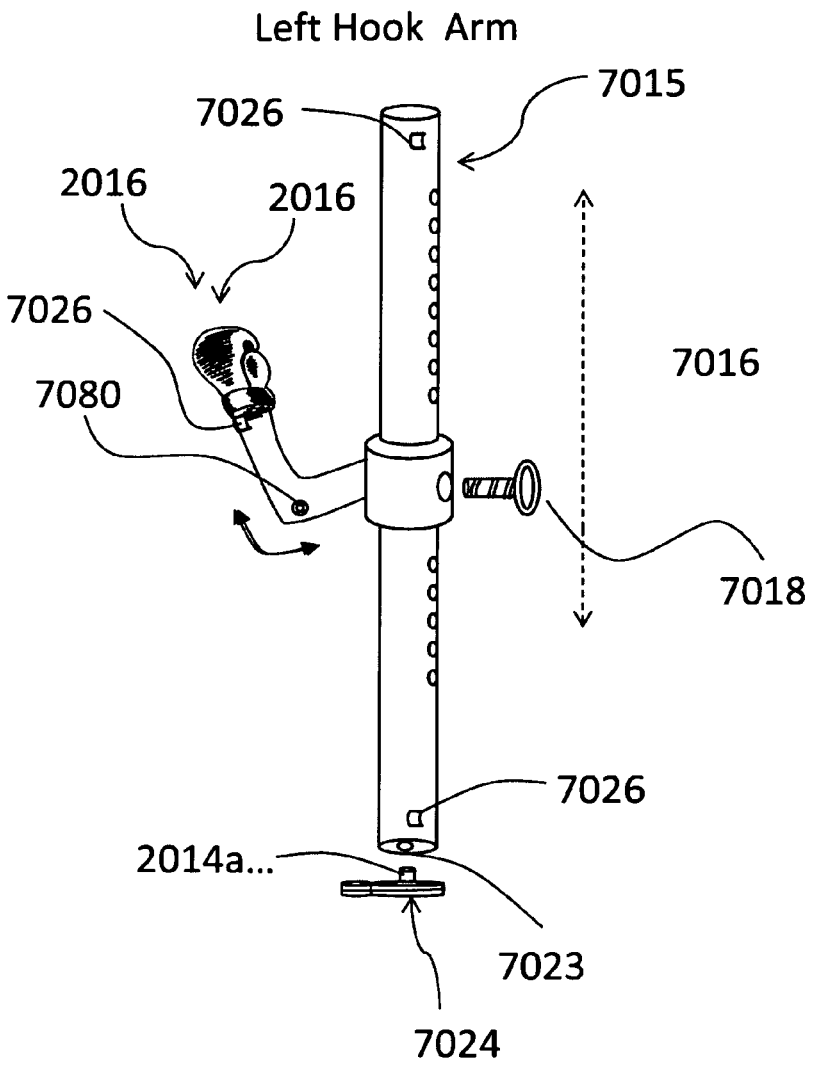
FIG. 1*j* illustrates views of the movable left hook arm configuration of the slip and counter machine of FIG. 1*a;*
Figure 1K:
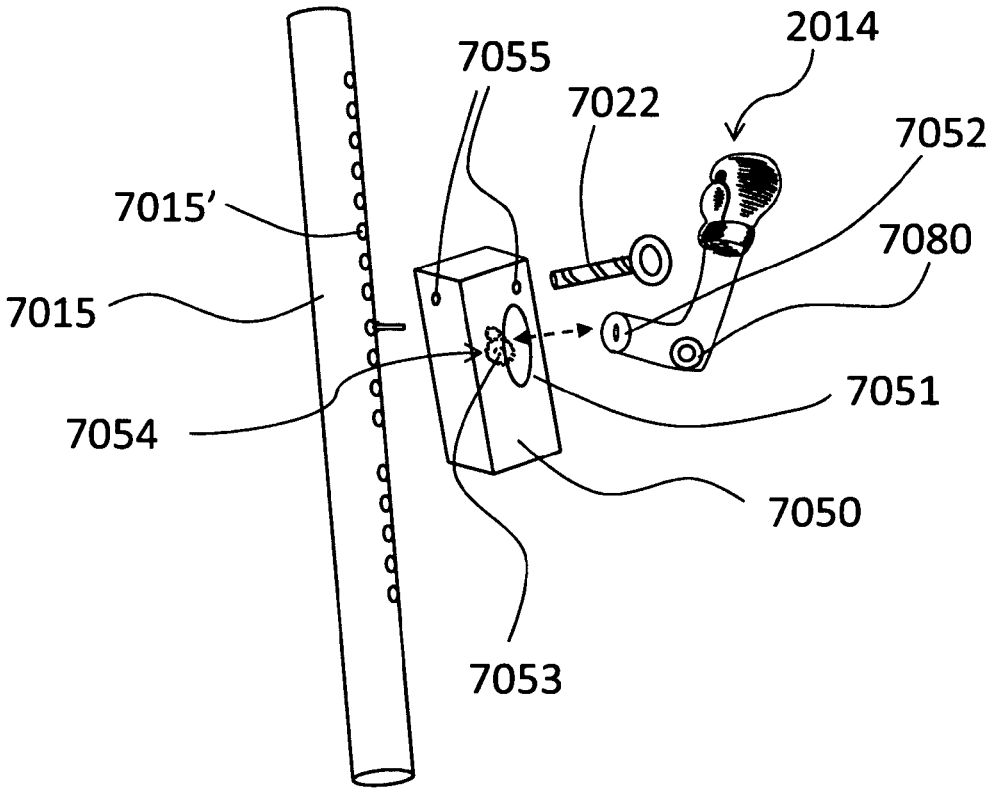
FIG. 1*k* illustrates views of the movable right uppercut arm configuration of the slip and counter machine of FIG. 1*a;*
Figure 1L:
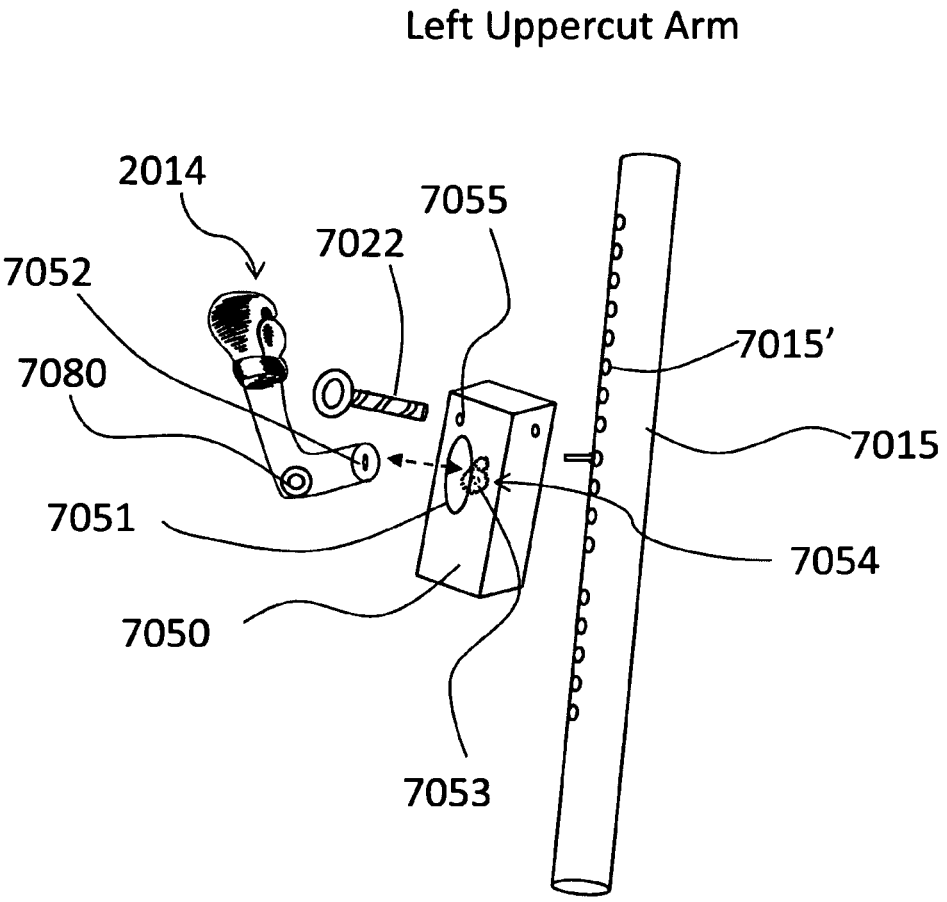
FIG. 1*l* illustrates views of the movable left uppercut arm configuration of the slip and counter machine of FIG. 1*a;*

FIG. 1*g* illustrates views of the movable left straight arm 2015 configuration of the slip and counter machine of FIG. 1*a*. FIG. 1*h* illustrates views of the movable right straight arm 2015 configuration of the slip and counter machine of FIG. 1*a*. FIG. 1*i* illustrates views of the movable right hook arm 2016 configuration of the slip and counter machine of FIG. 1*a*. FIG. 1*j* illustrates views of the movable left hook arm 2016 configuration of the slip and counter machine of FIG. 1*a*. FIG. 1*k* illustrates views of the movable right uppercut arm 2014 configuration of the slip and counter machine of FIG. 1*a*. FIG. 1*l* illustrates views of the movable left uppercut arm 2014 configuration of the slip and counter machine of FIG. 1*a*.

Referring generally to FIGS. 1*g*-1*l*, the two side walls of the slip and counter machine are connected to poles 7015 having height adjustable holes 7016 for moving a t-bar 7017 with a corresponding hole for receiving a pin 7018 for height adjustment along pole 7015. T-bar 7017 is attached to a secondary pole 7020 via a swivel joint 7021. Straight arms 2015 of FIGS. 1*g*-1*h* include holes 7019 to change the length of the arm 2015. The straight arms 2015 have the ability to be angled either upward or downward by utilizing the swivel joint 7021 between the straight arms 2015 and pole 7015. The preferred angle, just like the preferred height will be held in place by a long threaded tightening knob, or pin 7022. There's a hole 7023 in the bottom of the pole so that two wheels with a belt 7024 are integrated therein that moves the wheels and belt so that the pole 7015 slides into the pole via at least one prong 2014*a-f* that's connected to the wheels 2013' (see FIGS. 1*a* and 1*b*). Although the gloves on the arms are pillow soft, preferably various proximity sensors 7026 are provided for safety. Preferably the sensors 7026 are at top and/or bottom of the poles and wrist of arms. Only the pillow soft glove will hit the user.

Referring generally to FIGS. 1*k*-1*l*, hook arms 2014 slide into a fairly-long box 7050 that has an elongated hole 7051 in it so that the arms 2014 will have enough room to go up and down. Hook arms 2014, 2016 include an elbow joint 7080 and an aperture 7052 therein adapted to receive a prong 7053 that is connected to wheels with belt 7054 there around to move the arms 2014 up and down, all inside of box 7050. The box 7050 has a hole 7055 in the front and the back that will align with the holes 7015' on the pole 7015 and will be held in place with a long threaded pin 7022 or threaded knob. Also the slip and counter machine of FIG. 1 can work with poles exposed as well, with no side walls at all or outer casing, with at least 1 or 2 arms. Pads may be provided around each of the arms. In this configuration, at least one arm can now come towards a user simultaneously, to practice fighting against a few people at once. Lastly, although that multi-headed, multi-abdomen, multi-armed alien apparatus has a few protruding arms, it absolutely is not a slip and counter apparatus. The multi-armed apparatus simply allows a user to practice against various boxing styles and how to punch, knee, flying knee or kick regardless to the position of opponent's arms or head. Each side poses a different challenge.

Figure 2A:
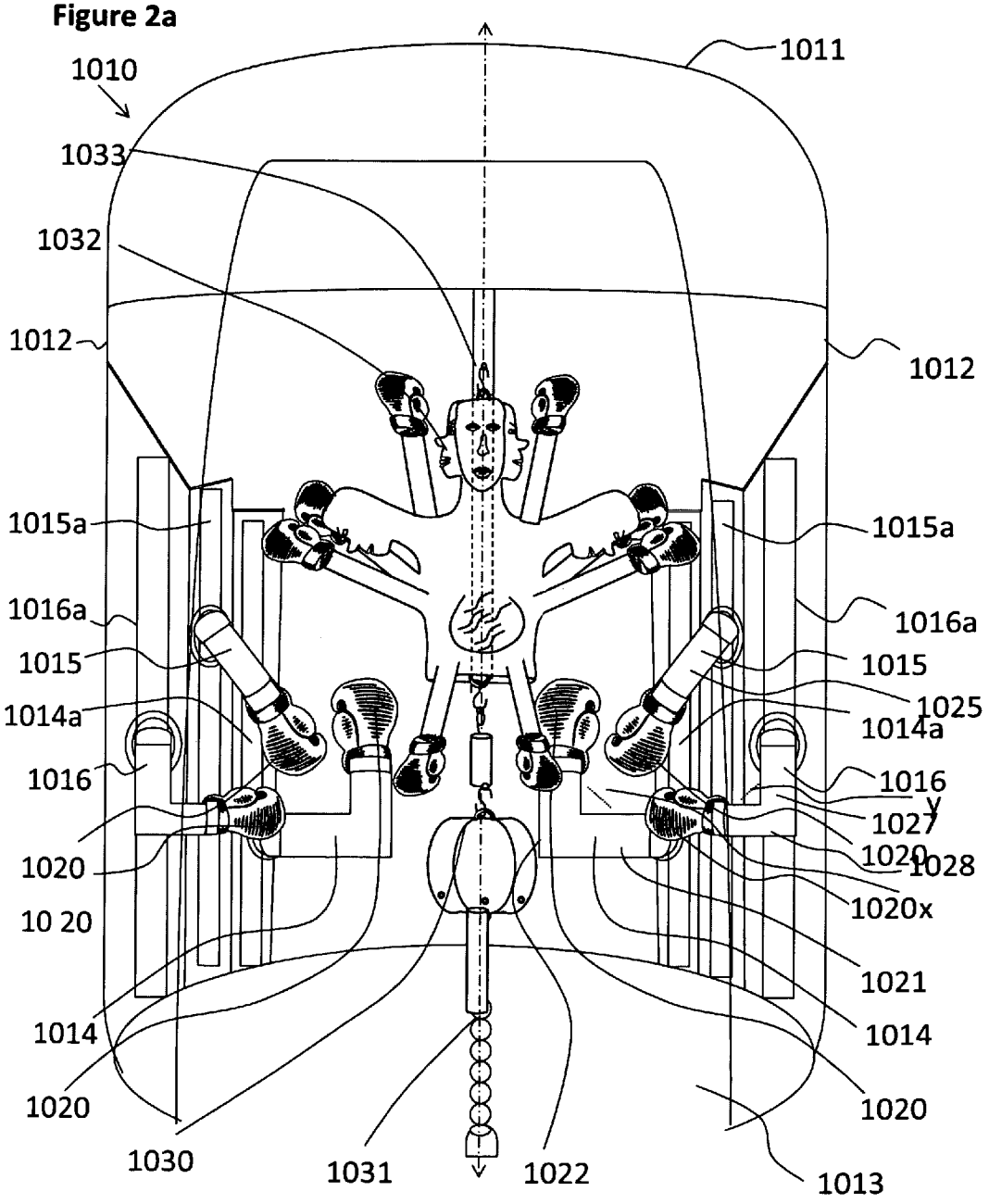
FIG. 2*a* illustrates a perspective view of an embodiment of the fight simulation apparatus of the subject invention, with a round or punch-able multi-stomach mid section member counter area/element.
Figure 2B:
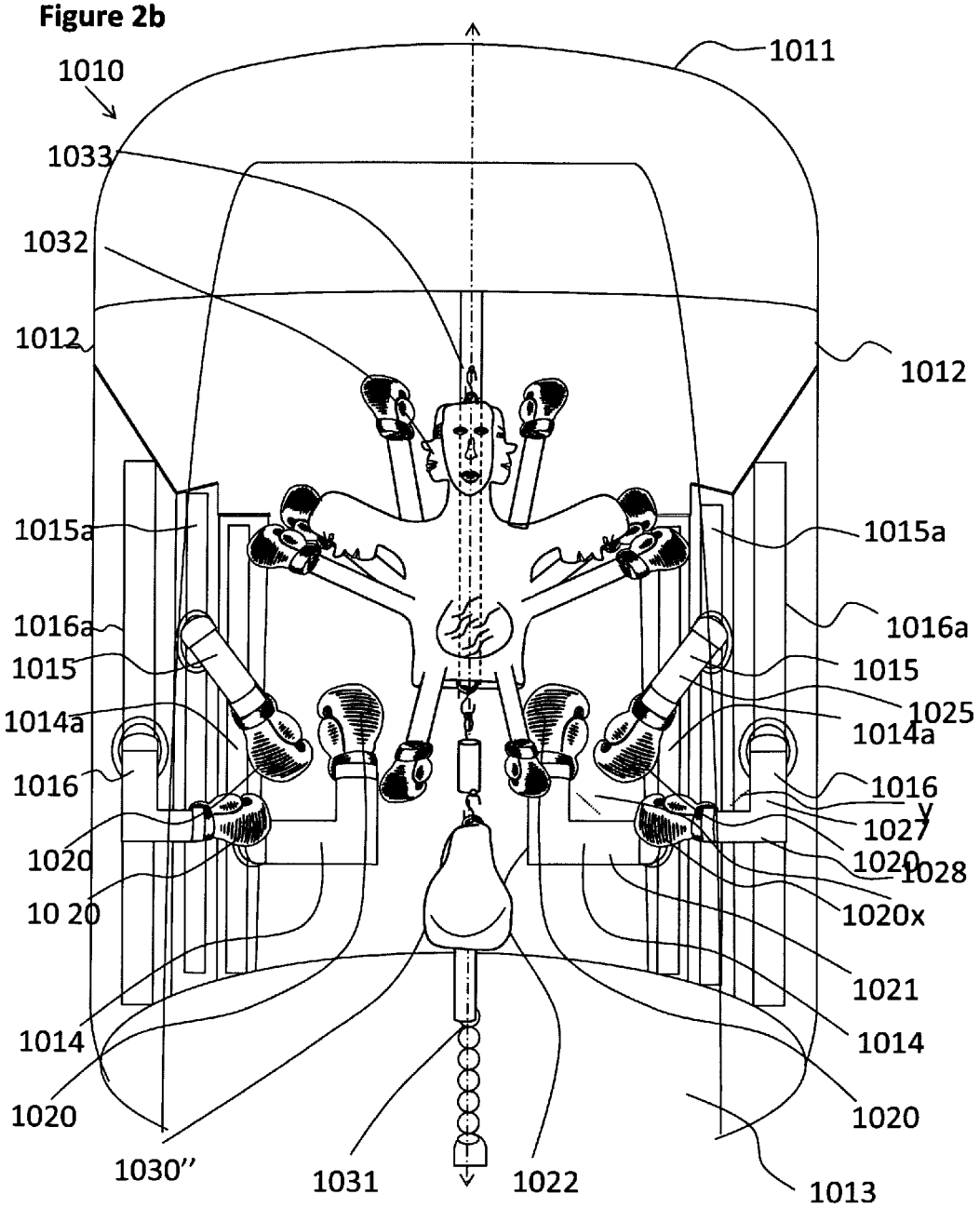
FIG. 2*b* illustrates the perspective view of the embodiment of FIG. 2*a*, however with a single round or punch-able stomach mid section member counter area/element to illustrate interchangeability of the members.
Figure 2C:
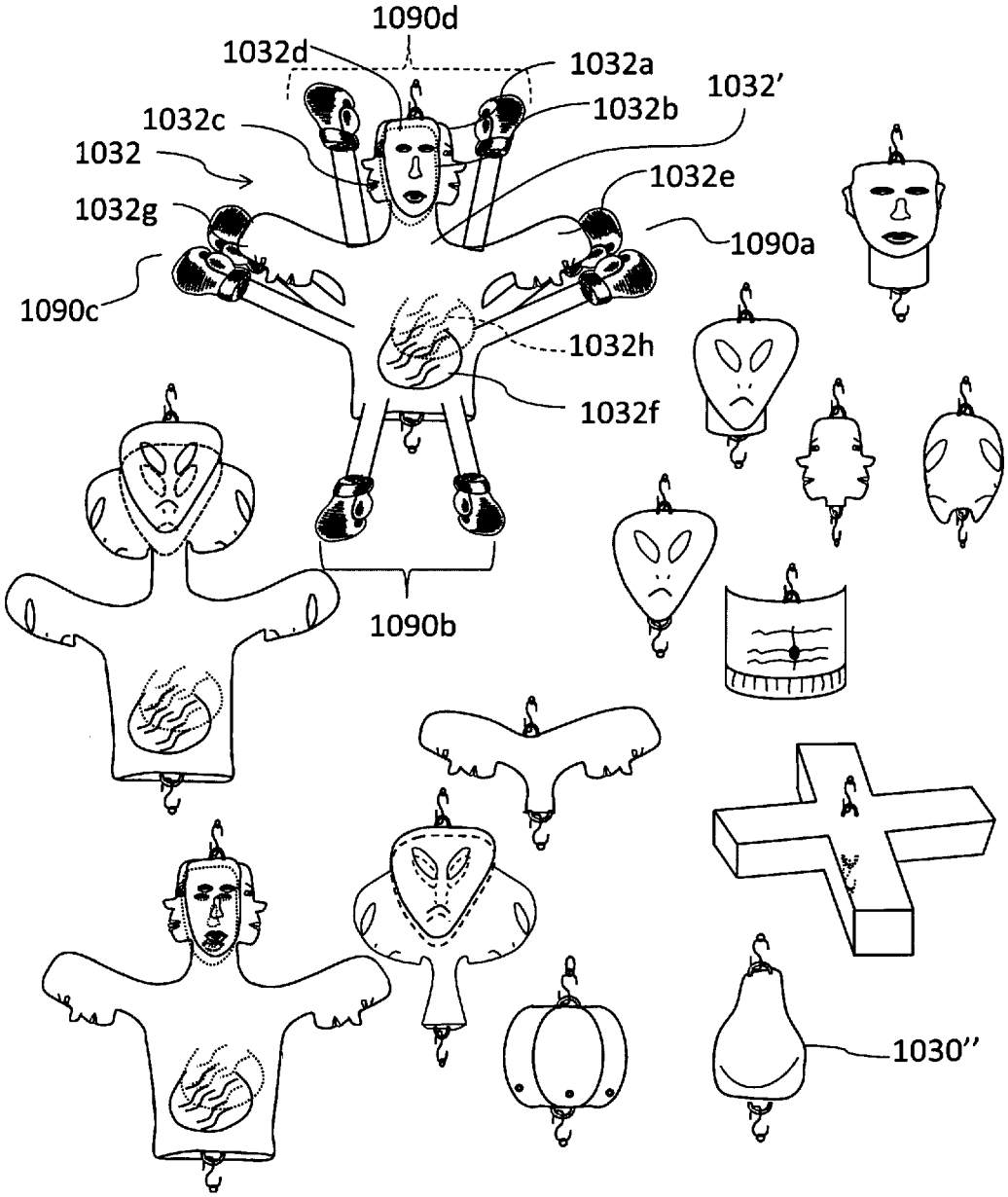
FIG. 2*c* illustrates views of the different punch-able members that can be interchanged on the apparatus, including showing the multi-headed member, a single head member, a single stomach member, and the multi-stomach member.
Figure 2D:
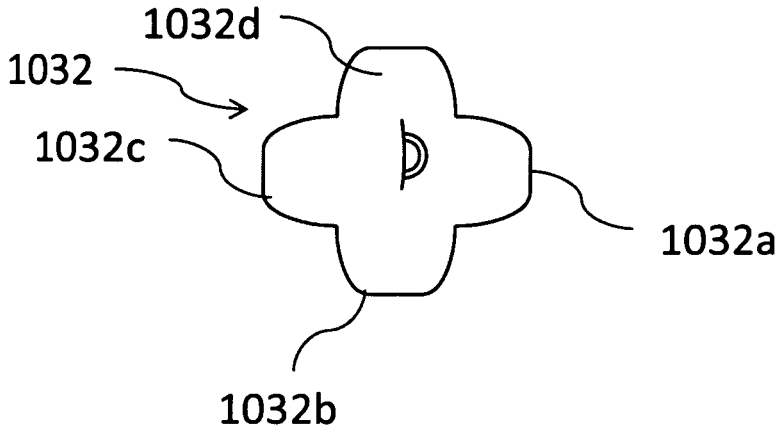
FIG. 2*d* illustrates a top view of the multi-head member.
Figure 2E:
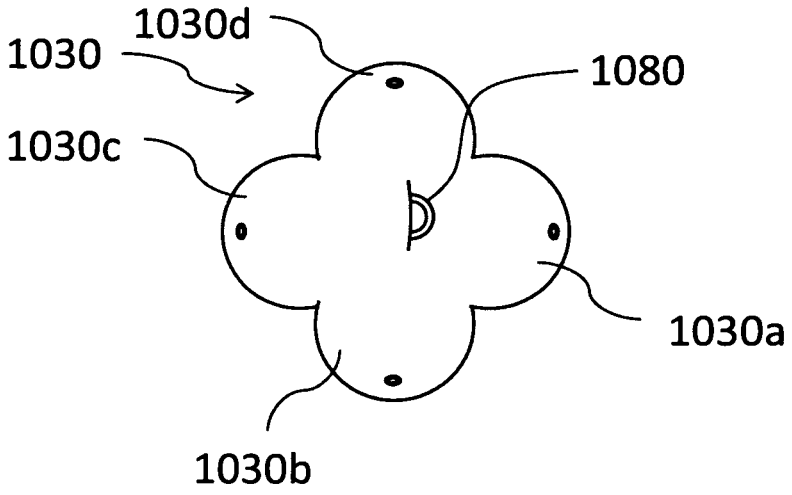
FIG. 2*e* illustrates a top view of the multi-stomach member.
Figure 3:
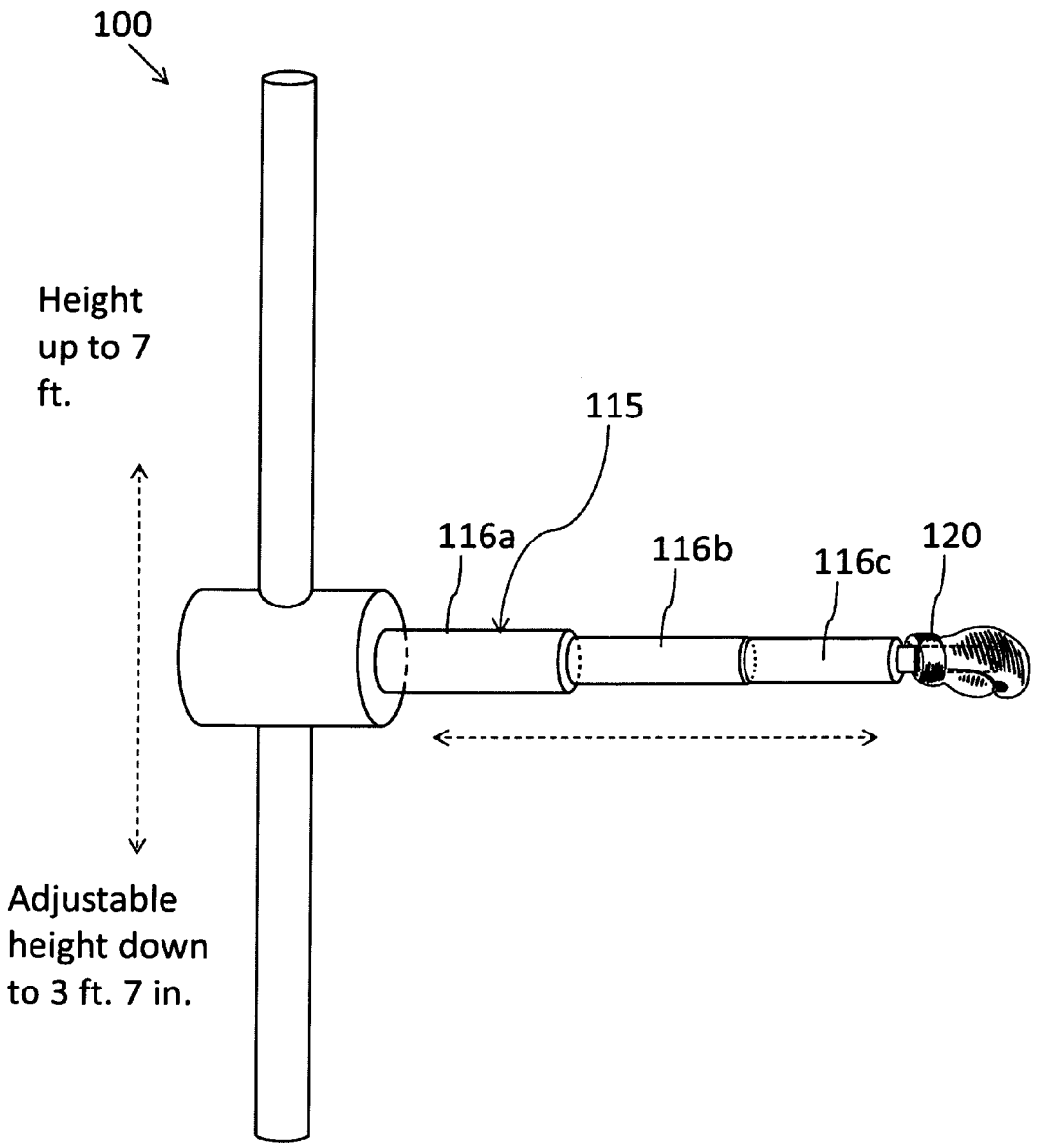
FIG. 3 illustrates a view of a center arm or straight punch arm wherein the arm is telescoping for length extension.

FIGS. 2*a*-2*e* illustrate perspective views of the subject flight simulation apparatus and interchangeable elements thereof. FIG. 2*a* illustrates a perspective view of an embodiment of the fight simulation apparatus of the subject invention, with a round or punch-able multi-stomach mid section member counter area/element. FIG. 2*b* illustrates the perspective view of the embodiment of FIG. 2*a*, however with a single round or punch-able stomach mid section member counter area/element to illustrate interchangeability of the members. FIG. 2*c* illustrates views of the different punch-able members that can be interchanged on the apparatus, including showing the multi-headed member, a single head member, a single stomach member (1030"), the multi-stomach member, 4-headed alien member, and 4-sided cross pads. FIG. 2*d* illustrates a top view of the multi-head member. Lastly, FIG. 2*e* illustrates a top view of the multi-stomach member.

FIG. 2*a* illustrates a perspective view of an embodiment of the fight simulation/workout machine, shown generally at 1010. FIG. 2*b* illustrates the perspective view of the embodiment of FIG. 2*a*, however with a round or punch-able mid/stomach section counter area/element interchanged in. Referring to FIGS. 2*a*-2*d*, the fight simulation/workout machine 1010 generally includes a U-Shaped construct having a top wall 1011, at least two parallel side walls 1012 arranged opposite from one another with an optional, but not required, bottom floor mat 1013. As used herein, the term "U-Shaped" is meant to be a ground view of the device 1010 as one stands directly in front of the device 1010. In this manner, a user is appointed to walk into the U-shape between the side walls 1012 and is thus substantially surrounded by the device. That is to say, the user's front, and sides are in proximity with the side walls 1012 of the device as the user walks inside the U-shape; providing a device 1010 having side walls 1012 forming an arc ranging from about 90 degrees up to about 270 degrees.

Preferably, the side walls 1012 are arced or curved and form a semi-circle of about 180 degrees. In this manner, fight simulation is optimized to substantially surround a user who walks into the U-shaped device (sides and front of user).

The slip and counter machine may include a sensor for activating or turning on the machine 1010. Alternatively, the device may be constructed with/without a bottom floor mat 1013 and instead there may simply be a sensor beam located near the bottom of one or more of the side walls 1012, or top wall 1011. Sensors are preferably located within or in close proximity to the movable arms of the slip and counter machine. It is further contemplated that the device may be constructed without a top wall 1011. In any event, the device includes side walls 1012 constructed in a manner so that a user can step into the device 1010 and the side walls 1012 substantially surround the user in that the side walls 1012 are located on the sides and front of the user.

Within side walls 1012 there are a series of arms 1014, 1015, 1016 extended within first, second and third slots 1014*a*, 1015*a*, 1016*a*, respectively, that allow the arms to adjust height wise from the floor mat 1013, on a substantially vertical plane. The slots 1014*a*, 1015*a*, 1016*a* or tracks are located substantially parallel to one another and are substantially perpendicular to the bottom floor mat 1013. Preferably there are three arms 1014, 1015, 1016 as shown, each located in separate slots 1014*a*, 1015*a*, 1016*a* and each being capable of being adjusted along the vertical plane extending from the floor/ground level/or bottom floor mat 1013. Each of the arms 1014, 1015, 1016 are spaced and constructed to deliver different punch types/provide different extension ranges for delivery of different punches, as discussed hereinafter.

The arms 1014, 1015, 1016 are provided within slots 1014*a*, 1015*a*, 1016*a* so that the arms 1014, 1015, 1016 vertically traverse the slots 1014*a*, 1015*a*, 1016*a* to accommodate users of varying heights. The arms and slots may include tongue and groove mating means, with teeth and mating slots. Alternatively, hydraulics and/or electronics may be used for movement of the arms 1014, 1015, 1016 along slots 1014*a*, 1015*a*, and 1016*a*.

Each of the arms 1014, 1015, 1016 includes a glove appendage member 20 thereon. Preferably, glove appendage members 20 are removable and different grade glove members 20 are provided, including pillow soft, soft, medium, hard.

Arm 1014 includes at least on elbow joint connecting an upper arm portion 1021 and a lower arm portion 1022 and provides an angle x located there between. FIG. 5 illustrates arm 1014, 1016 jointed configurations. Arm 1014 is appointed to deliver uppercut type punches. Arm 1016, like arm 1014, includes an elbow joint connecting an upper arm segment 1027 and a lower arm segment 1028 and provides an angle y located there between. Arm 1016 is appointed to deliver hook type punches. Advantageously, the purpose for the elbow joints on the hook arms 1016 are for tighter hooks, in case a user prefers fighting up close. The purpose for the elbow joints on the uppercut arms 1014 is so the half uppercut-half hook punch can be thrown.

In contrast, arms 1015, located centrally between arms 1014 and 1016, and are preferably constructed on as straight members 1025 that are angled downward (or upward) from side walls 1012. Preferably, arms 1015 slant or angle toward the center of the device 1010 and said angle is adjustable as illustrated by way of FIG. 4. As so constructed, arm 1015 delivers straight punches. Preferably, arms 1015 are provided as telescoping arms as shown in FIGS. 2 and 3.

Continuing with FIGS. 2*a* and 2*b*, counter areas/elements are provided, generally including a mid/stomach section counter area/element 1030 (1030' in FIG. 2*b*: providing a punch-able element like structure embodiment) having a strong cable 1031 or bungee cord, and a counter area/element shown as a multi headed member 1032. Cable 1031 may be composed of a flexible material so that the cable 1031 gives a little to avoid hurting the user's wrists; alternatively, cable 1031 may be composed of a rigid material but in such an event cable 1031 has some slack in order to give so it won't hurt the user's wrists. The counter areas are to be positioned in the back and center of the machine, the same way a user's body would be behind his/her arms in the fighting position.

Each of the counter elements, herein 1030 and 1032, are interchangeable, including use of the different punch-able members that can be interchanged on the apparatus, including showing the multi-headed member, a single head member, a single stomach member, and the multi-stomach member. These members are shown for example in FIG. 2*c*.

In the embodiment shown, and referring to FIGS. 2*a*, 2*b* and 2*d* specifically, a multi headed member 1032 is provided having eight heads 1032*a*-*h*, each with faces thereon (see FIG. 2*c*). The top portion 1032' of the multi headed member 1032 is constructed having four heads 1032*a*-*d* (see FIG. 2*c*), interconnected to one another. Directly on the top center there is a u-shaped loop 1032" for an s-hook 1033 to hook onto. Top portion 1032' extends to an abdomen which in turn includes four more heads 1032*e*-*h* (heads 1032*f* and 1032*h* are shown as back of heads inasmuch as they are angled downward at an angle). These heads 1032*e-h* are faced in an angle a little higher than facing towards the ground, and the necks are somewhat long. The angle of these heads 1032*e-h* preferably ranges from 30 degrees to 80 degrees in relation to the horizontal plane or ground surface. More preferably, the angle ranges from 35 degrees to 55 degrees. Most preferably, the angle is about 45 degrees. The plurality of heads provides various heads for numerous positions, strikes, timing, speed and accuracy. Preferably there are at least two heads, more preferably there are at least four heads, and most preferably there are at least eight heads as shown (as shown). [see FIG. 2*c* for more embodiments]. This multi headed apparatus most preferably has a total of eight faces and five heads. The side of each face on the four sided head preferably terminate or stop right before where an ear would appear, such as on a typical human head, so that the side of each head can be hit. Consequently, there will be no ears or back of head on the four face head portion of the multi headed member.

In the embodiment shown, and referring to FIGS. 2*a*, 2*b* and 2*e* specifically, a multi stomach member 1030 is provided having four stomachs 1030*a-d*. In this manner, as opposed to striking just one stomach hooked on to one end of a bungee cord, the user can strike various stomachs. Directly on the top center of the four sided portly stomachs there is a u-shaped loop 1080 for an s-hook 1022 to hook onto. Likewise concerning the multi stomach member, preferably each stomach will have each side exposed for side hits, but no backs will be exposed or provided.

Additionally, at least one set of arms 1090 is provided. Most preferably eight sets of arms are provided, 1090*a-d* (see FIG. 2*c*). The hands of the arms are preferably in the form of boxing gloves. On set of the arms is located in the front of the faces of the upper four faced head portion with gloved hands protecting both sides of the chin. The other three sets of arms are located in front of three out of the four angled heads; with extra arms being located on the apparatus in varying locations. Though the gloved hands are located on the side of the chins, none of the gloved hands are too close to the chins as there must be enough space for the user to punch around the arms and gloves of the apparatus. The multi headed member bottom preferably includes a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The machine is preferably constructed having a U-shaped or arc-shaped construction. The uppercut slot 1014*a* for the uppercut arm 1014 is located the furthest away from the user and the closest arms towards the back of the device 1010, close to the counter areas/elements. The second or middle slot 1015*a* is appointed to deliver straight punches via the straight arm 1015. The third slot 1016*a* is for holding hook arm 1016 and for thus delivering deliver hook type punches. The straight arms 1015/second slot 1015*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 1013. The slots 1014*a*, 1015*a*, 1016*a* are designed to have the capability to make the arms 1014, 1015, 1016 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (1015) can be adjusted down low and slant in an upward position, for a taller person to practice fighting a shorter person. Also, preferably the hook arms and the uppercut arms (1016, 1014, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. Moreover, the machine control pad includes different speeds and user levels, including slow, fast, faster, pro speeds; and/or levels of beginner, intermediate, or advanced.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 3 illustrates a view of a center arm or straight punch arm wherein the arm is telescoping for length extension, shown generally at 100. As herein illustrated, straight arm 115 (arm 15 in FIG. 1) located centrally to the other arms, preferably includes telescoping members 116*a-n*. Telescoping members 116*a-n* slide within each neighboring member so that the arm 115 can be extended lengthwise. The members 116*a-n* may include locking mechanisms and marking or measuring mechanisms for length adjustment. Preferably, to ensure a user does not get injured, a sensor 120 is incorporated in the wrist area of all the six arms, as indicated herein. The sensor 120 assures that the mechanical arms stop at roughly one foot from the user. Pillow soft gloves for example should be about one foot two inches long on all six arms.

Figure 4:
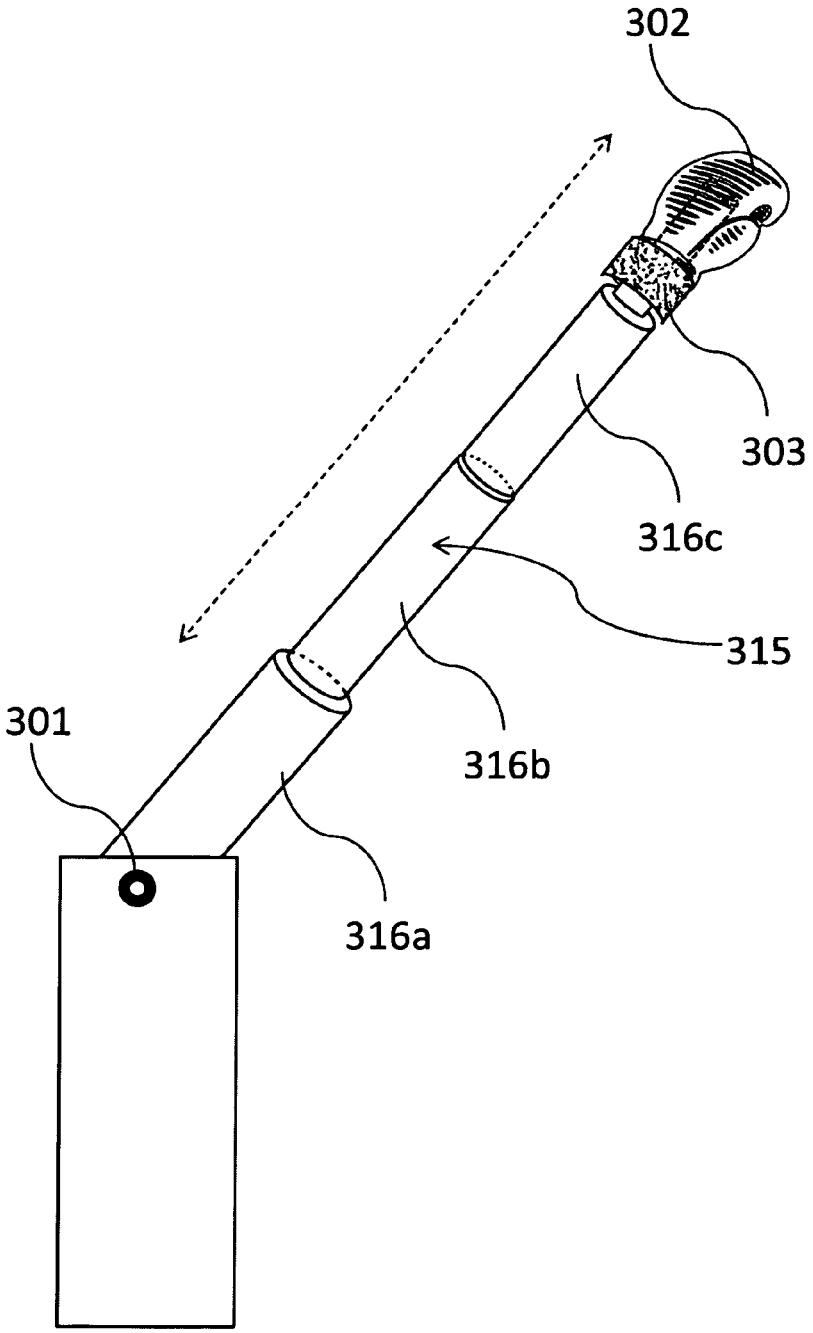
FIG. 4 illustrates a view of a center arm or straight punch arm wherein the arm is telescoping for length extension and is provided with a flexible joint at the slot-arm interface.

FIG. 4 illustrates a view of a center arm or straight punch arm 315 (i.e. arm 15 of FIG. 2) wherein the arm is telescoping for length extension and is provided with telescoping members 316*a-n* attached to a flexible joint 301 at the slot-arm interface. Pillow gloves 302 should be about one foot 2 inches long. A sensor 303 is provided at the wrist of the glove for preventing actual contact or to mitigate contact force. As sensor 303 senses the user's body within close proximity the arm movement slows or stops to prevent or mitigate contact force. The position of the arm as shown in the figure illustrates an example of when a tall person sets the angle and height extension of arm 315 as if practicing to fight a shorter person and vice versa.

FIG. 5 illustrates a view of a left hook arm, showing flexible joints, shown generally at 400. Left hook arm 414 is appointed to deliver uppercut type punches. Arm 414 includes at least one elbow joint 417*a-n* and wrist sensor 420. The purpose for the elbow joints is to provide tighter hooks, in case a user prefers fighting up close.

Figure 6:
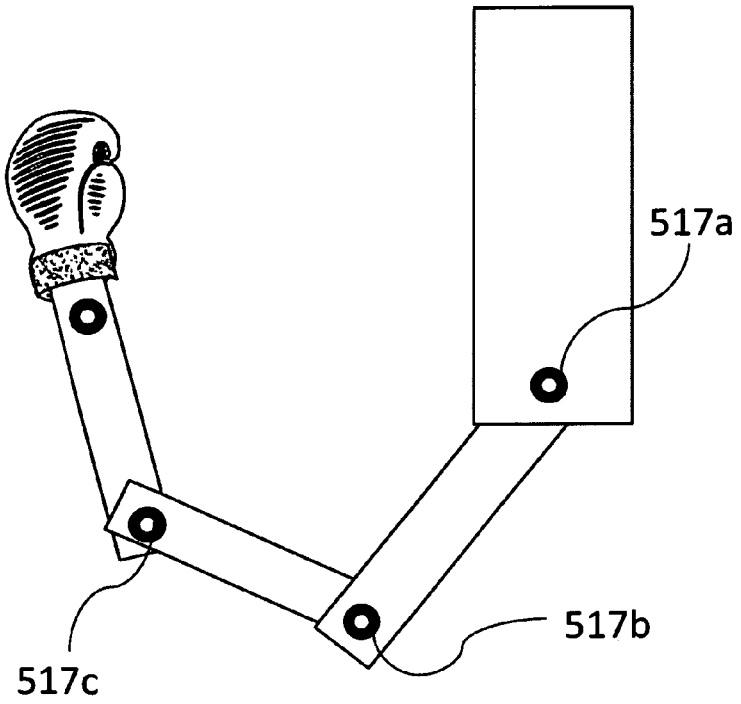
FIG. 6 illustrates a view of a left upper-cut arm, showing flexible joints.

FIG. 6 illustrates a view of a left upper-cut arm, showing flexible joints 517*a-n*. The machine is preferably shaped like a capital letter D without the straight line, or a U-shape, like a boomerang shape. The straight arms should have the ability to change reach for different size users. For example, various fighters have varying arm reaches: 80" reach (taller users), 72" reach (average height male), 65" reach (for smaller users), 60" reach, and 52" setting (for small users). A sensor may be integrated into the floor matt of the machine that triggers the machine into the on position and activates the arms. The sensor can begin after a time interval, such as 3-2-1, in order for the user to get ready for the simulation.

Figure 7:
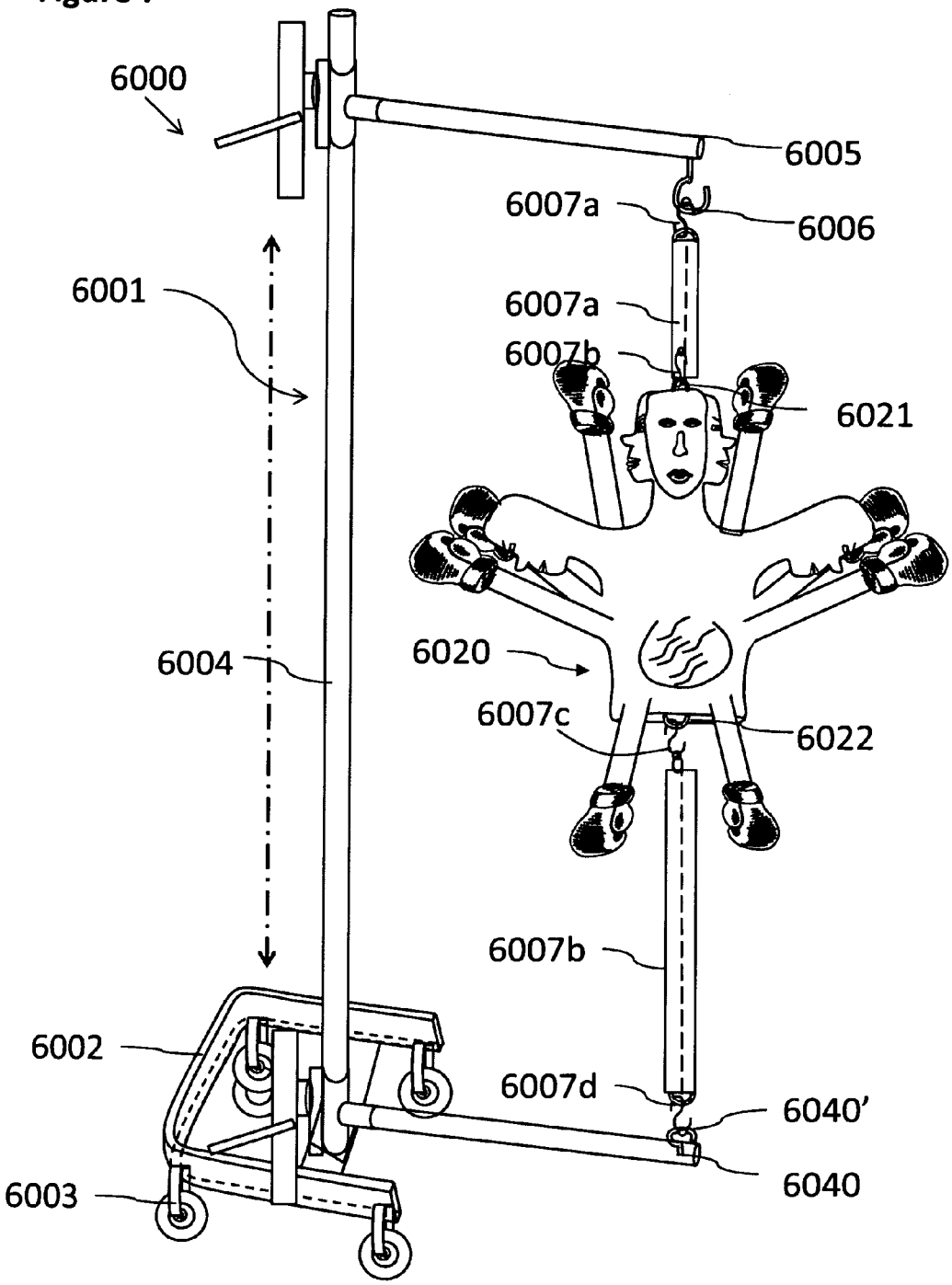
FIG. 7 illustrates a view of an embodiment of the subject invention wherein a mobile free multi-head member is provided.

FIG. 7 illustrates a view of an embodiment of the subject invention wherein a mobile free standing slip and counter machine is provided, shown generally at 6000. The free standing flight simulation workout machine 6000 comprises a main support structure 6001 formed herein with a base 6002 having locking wheels 6003 thereon for moving of the structure 6001. The structure 6001 further includes a vertical pole member 6004 extending upward with movable or height adjustable horizontal pole member 6005 extending horizontally therefrom. Horizontal pole member 6005 can be moved up and down vertical pole member 6004 for height adjustment. On the bottom side of horizontal pole member 6005 is a mounting loop 6006 thereon for attaching a first s-hook 6007*a* thereto, the first s-hook 6007*a* further is connected to a first cord (bungee) 6008*a*. The other end of first cord 6008*a* in turn is adapted to receive another s-shaped hook 6007*b*. At least one counter area/element 6020 is provided including a top having a u-shaped loop 6021 thereon for receiving second s-shaped hook 6007*b* adapted to be attached to the first cord 6008*a*. The counter area/element 6020 includes a bottom having a u-shaped loop 6022 thereon for receiving a third s-shaped hook 6007*c* adapted to be attached to a second cord 6008*b*, the second cord (bungee) 6008*b* having a fourth s-shaped hook 6007*d* attached on an opposite end thereof. A base portion 6040 is provided and includes a base loop 6040' that removably connects to the fourth s-shaped hook 6007*d*.

Preferably, the counter area/element 6020 is shaped as a head, more preferably being a multi-head member having at least two heads; and most preferably being a multi-head member having eight heads as shown. Eight heads are shown which further extend to an abdomen portion with four pairs of arms extending therefrom (see FIG. 2*c*; 1032). Preferably a mid counter area/element is also provided, optionally including a multi-stomach mid counter area/element, which preferably includes at least four stomach portions forming a four sided portly stomach shown and described hereinabove.

Figure 8:
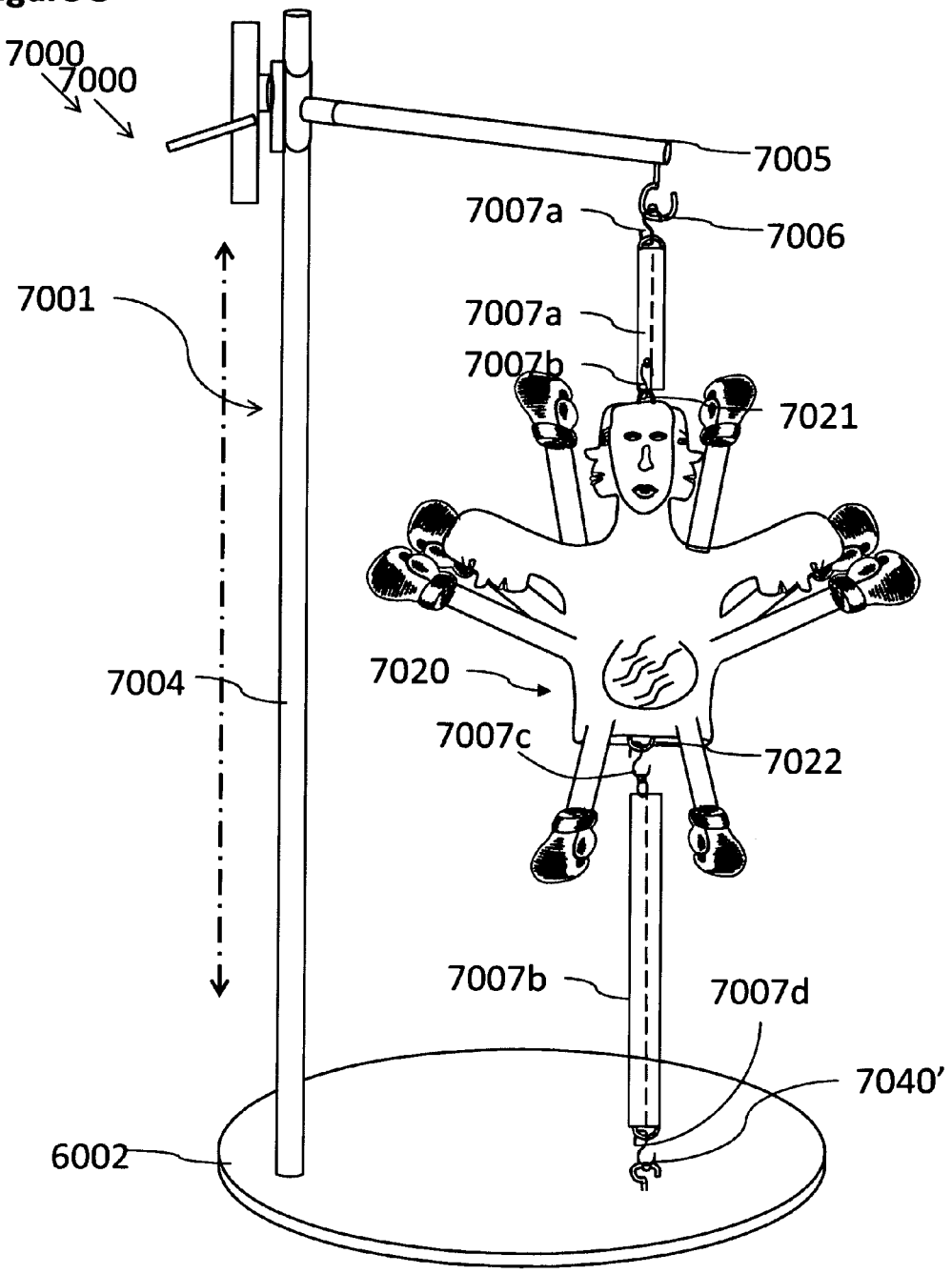
FIG. 8 illustrates a view of an embodiment of the subject invention wherein a free standing multi-head member is provided.

FIG. 8 illustrates a view of an embodiment of the subject invention wherein a free standing slip and counter machine is provided, shown generally at 7000. The free standing flight simulation workout machine 7000 comprises a main support structure 7001 formed herein with a base 7002 having platform 7003. The structure 7001 further includes a vertical pole member 7004 extending upward with movable or height adjustable horizontal pole member 7005 extending horizontally therefrom. Horizontal pole member 7005 can be moved up and down vertical pole member 7004 for height adjustment. On the bottom side of horizontal pole member 7005 is a mounting loop 7006 thereon for attaching a first s-hook 7007*a* thereto, the first s-hook 7007 further is connected to a first cord (bungee) 7008*a*. The other end of first cord 7008*a* in turn is adapted to receive another s-shaped hook 7007*b*. At least one counter area/element 7020 is provided including a top having a u-shaped loop 7021 thereon for receiving second s-shaped hook 7007*b* adapted to be attached to the first cord 7008*a*. The counter area/element 7020 includes a bottom having a u-shaped loop 7022 thereon for receiving a third s-shaped hook 7007*c* adapted to be attached to a second cord 7008*b*, the second cord (bungee) 7008*b* having a fourth s-shaped hook 7007*d* attached on an opposite end thereof. Base portion/platform 7003 include a base loop 7040' that removably connects to the fourth s-shaped hook 7007*d*.

Preferably, the counter area/element 7020 is shaped as a head, more preferably being a multi-head member having at least two heads; and most preferably being a multi-head member having eight heads as shown. Eight heads are shown which further extend to an abdomen portion with four pairs of arms extending therefrom (see FIG. 2*c*; 1032). Preferably a mid counter area/element is also provided, optionally including a multi-stomach mid counter area/element, which preferably includes at least four stomach portions forming a four sided portly stomach shown and described hereinabove.

In the embodiments shown in FIGS. 6 and 7, the counter elements are interchangeable, including use of the different punch-able members that can be interchanged on the apparatus, including showing the multi-headed member, a single head member, a single stomach member, and the multi-stomach member. These members are shown for example in FIG. 2*c*.

Figure 9A:
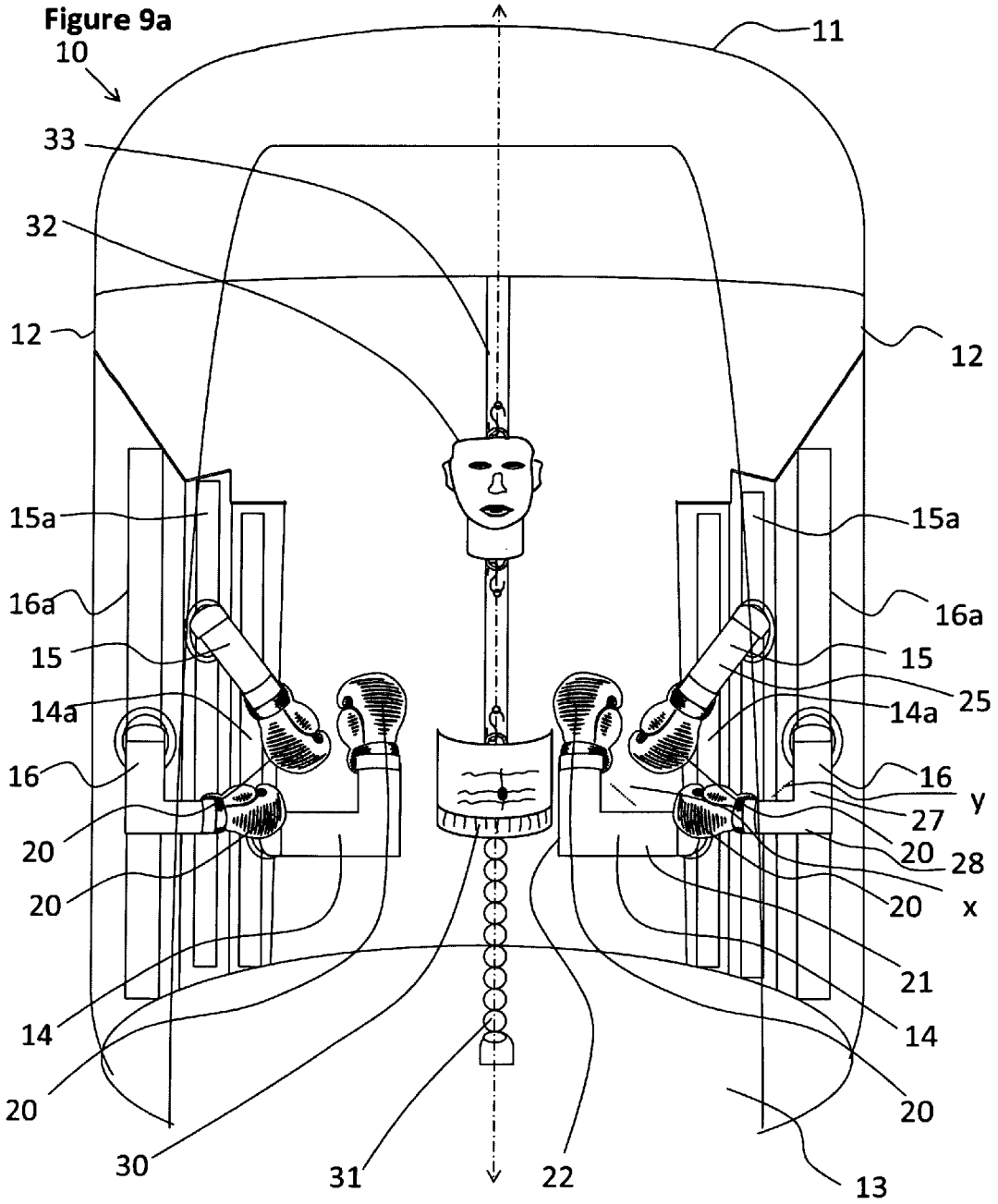
FIG. 9*a* illustrates a perspective view of an embodiment of the fight simulation apparatus of the subject invention.
Figure 9B:
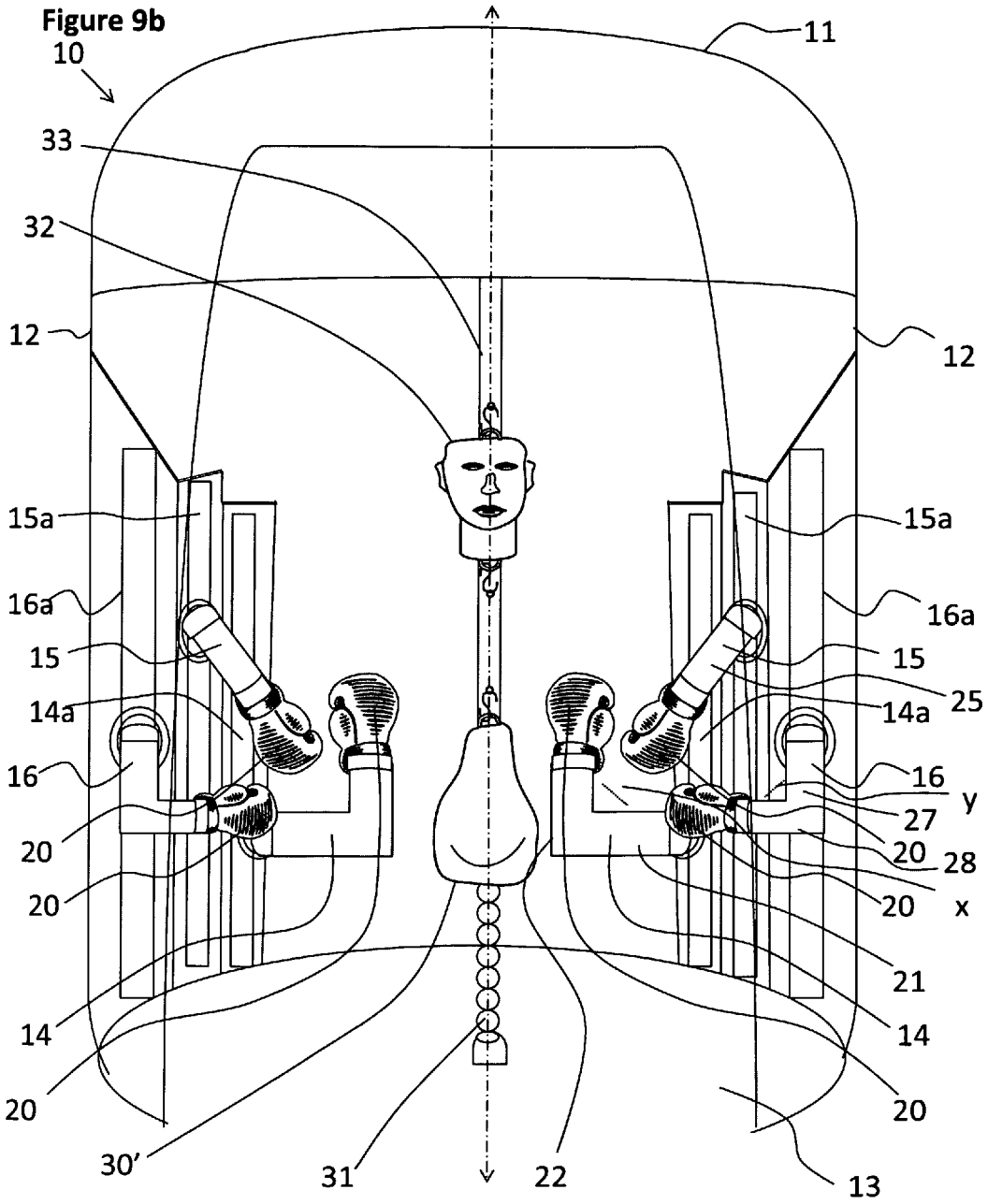
FIG. 9*b* illustrates the perspective view of the embodiment of FIG. 2*a*, however with a round or punch-able mid section counter area/element.

FIG. 9*a* illustrates a perspective view of an embodiment of the fight simulation/workout machine, shown generally at 10. FIG. 9*b* illustrates the perspective view of the embodiment of FIG. 9*a*, however with a round or punch-able mid/stomach section counter area/element. Referring to FIGS. 9*a* and 9*b*, the fight simulation/workout machine 10 generally includes a U-Shaped construct having a top wall 11, at least two parallel side walls 12 arranged opposite from one another, and a bottom floor mat 13. As used herein, the term "U-Shaped" is meant to be a ground view of the device 10 as one stands directly in front of the device 10. In this manner, a user is appointed to walk into the U-shape between the side walls 12 and is thus substantially surrounded by the device. That is to say, the user's front, and sides are in proximity with the side walls 12 of the device as the user walks inside the U-shape; providing a device 10 having side walls 12 forming an arc ranging from about 90 degrees up to about 270 degrees. Preferably, the side walls 12 are arced or curved and form a semi-circle of about 180 degrees. In this manner, fight simulation is optimized to substantially surround a user who walks into the U-shaped device (sides and front of user).

Bottom floor mat 13 may include a sensor therein for activating or turning on the machine 10. Alternatively, the device may be constructed without a bottom floor mat 13 and instead there may simply be a sensor beam located near the bottom of one or more of the side walls 12, or top wall 11. It is further contemplated that the device may be constructed without a top wall 11. In any event, the device includes side walls 12 constructed in a manner so that a user can step into the device 10 and the side walls 12 substantially surround the user in that the side walls 12 are located on the sides and front of the user.

Within side walls 12 there are a series of arms 14, 15, 16 extended within first, second and third slots 14*a*, 15*a*, 16*a*, respectively, that allow the arms to adjust height wise from the floor mat 13, on a substantially vertical plane. The slots 14*a*, 15*a*, 16*a* or tracks are located substantially parallel to one another and are substantially perpendicular to the bottom floor mat 13. Preferably there are three arms 14, 15, 16 as shown, each located in separate slots 14*a*, 15*a*, 16*a* and each being capable of being adjusted along the vertical plane extending from the floor/ground level/or bottom floor mat 13. Each of the arms 14, 15, 16 are spaced and constructed to deliver different punch types/provide different extension ranges for delivery of different punches, as discussed hereinafter.

The arms 14, 15, 16 are provided within slots 14*a*, 15*a*, 16*a* so that the arms 14, 15, 16 vertically traverse the slots 14*a*, 15*a*, 16*a* to accommodate users of varying heights. The arms and slots may include tongue and groove mating means, with teeth and mating slots. Alternatively, hydraulics and/or electronics may be used for movement of the arms 14, 15, 16 along slots 14*a*, 15*a*, and 16*a*.

Each of the arms 14, 15, 16 includes a glove appendage member 20 thereon. Preferably, glove appendage members 20 are removable and different grade glove members 20 are provided, including pillow soft, soft, medium, hard.

Arm 14 includes at least on elbow joint connecting an upper arm portion 21 and a lower arm portion 22 and provides an angle x located there between. FIG. 5 illustrates arm 14, 16 jointed configurations. Arm 14 is appointed to deliver uppercut type punches. Arm 16, like arm 14, includes an elbow joint connecting an upper arm segment 27 and a lower arm segment 28 and provides an angle y located there between. Arm 16 is appointed to deliver hook type punches. Advantageously, the purpose for the elbow joints on the hook arms 16 are for tighter hooks, in case a user prefers fighting up close. The purpose for the elbow joints on the uppercut arms 14 is so the half uppercut-half hook punch can be thrown.

In contrast, arms 15, located centrally between arms 14 and 16, and are preferably constructed on as straight members 25 that are angled downward (or upward) from side walls 12. Preferably, arms 15 slant or angle toward the center of the device 10 and said angle is adjustable as illustrated by way of FIG. 4. As so constructed, arm 15 delivers straight punches. Preferably, arms 15 are provided as telescoping arms as shown in FIGS. 2 and 3.

Continuing with FIGS. 9*a* and 9*b*, counter areas/elements are provided, generally including a mid/stomach section counter area/element 30 (30' in FIG. 9*b*: providing a punchable element like structure embodiment) having a strong cable 31 on it so that it does not move, and a head counter area/element 32 having rubber straps 33 so that it can move a little more, but not as much as a double end bag. Cable 31 may be composed of a flexible material so that the cable 31 gives a little to avoid hurting the user's wrists; alternatively, cable 31 may be composed of a rigid material but in such an event cable 31 has some slack in order to give so it won't hurt the user's wrists. The counter areas are to be positioned in the back and center of the machine, the same way a user's body would be behind his/her arms in the fighting position.

Figure 10A:
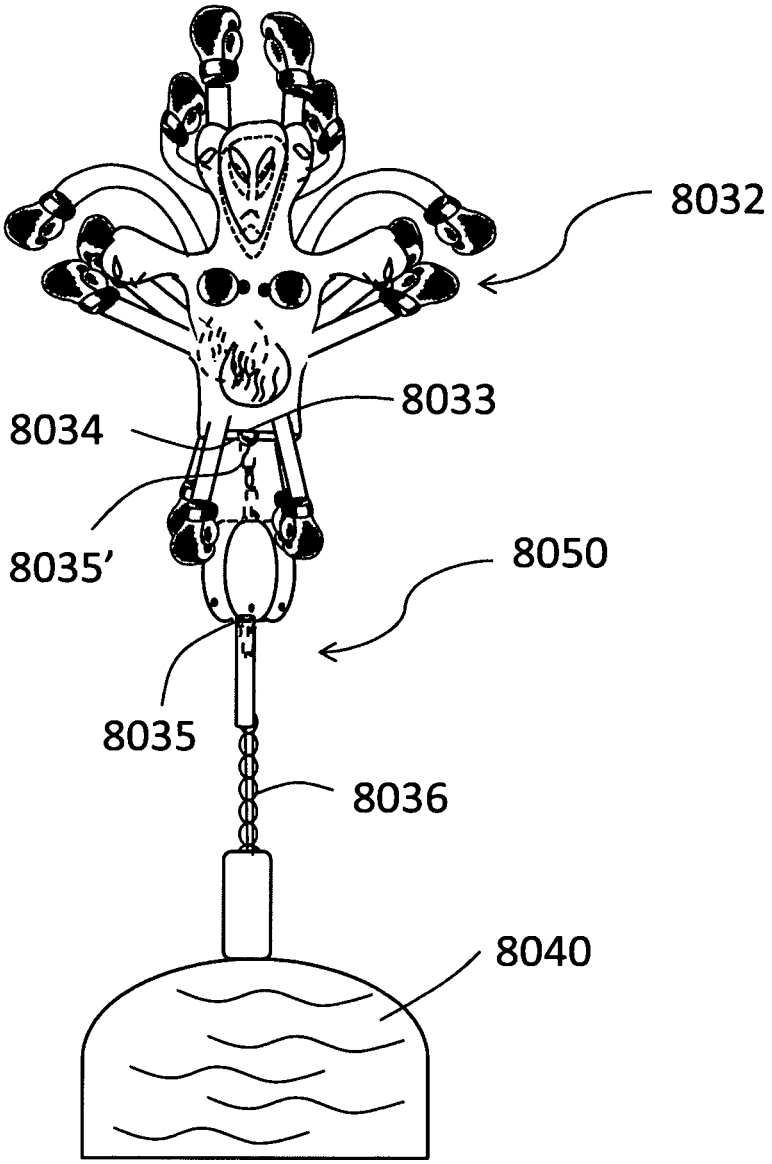
FIG. 10*a* illustrates a perspective view of the embodiment of the fight simulation apparatus of the subject invention where the multi-head, multi-abdomen, and multi-arm apparatus is removed from the slip and counter machine and placed on a free standing apparatus as a punching bag type structure (for example)
Figure 10B:
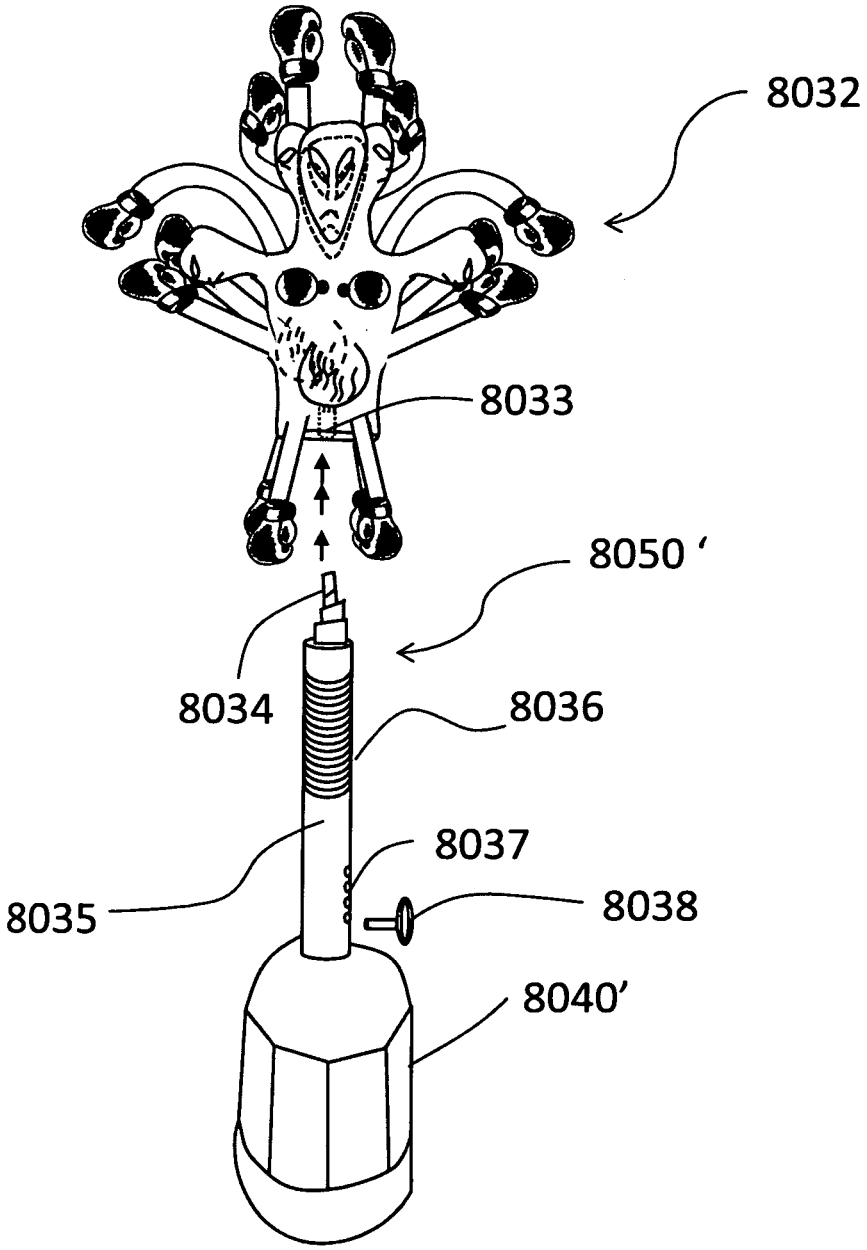
FIG. 10*b* illustrates a perspective view of the embodiment of the fight simulation apparatus of the subject invention where the multi-head, multi-abdomen, and multi-arm apparatus is removed from the slip and counter machine and placed on a free standing apparatus as a punching bag type structure (for example)

FIGS. 10*a*-10*b* illustrate views of the fight simulation apparatus of the subject invention where the multi-head, multi-abdomen, and multi-arm apparatus 8032 is removed from the slip and counter machine and placed on a free standing apparatus 8050, 8050' as a punching bag type structure (for example). Multi-arm apparatus 8032 includes a bottom threaded aperture 8033 adapted to receive a threaded member 8034 located on a hook 8035' or a strong flexible spring rod 8035 preferably having a spring member 8036 integrated therein for interchangeability. Height adjustable holes 8037 are provided for adjusting the height of rod 8035 and for insertion of a knob 8038 for securing to a base 8040, 8040' which may be filled with sand or water, or provided as an otherwise heavy base to prevent the apparatus from tipping or falling over.

Figure 11A:
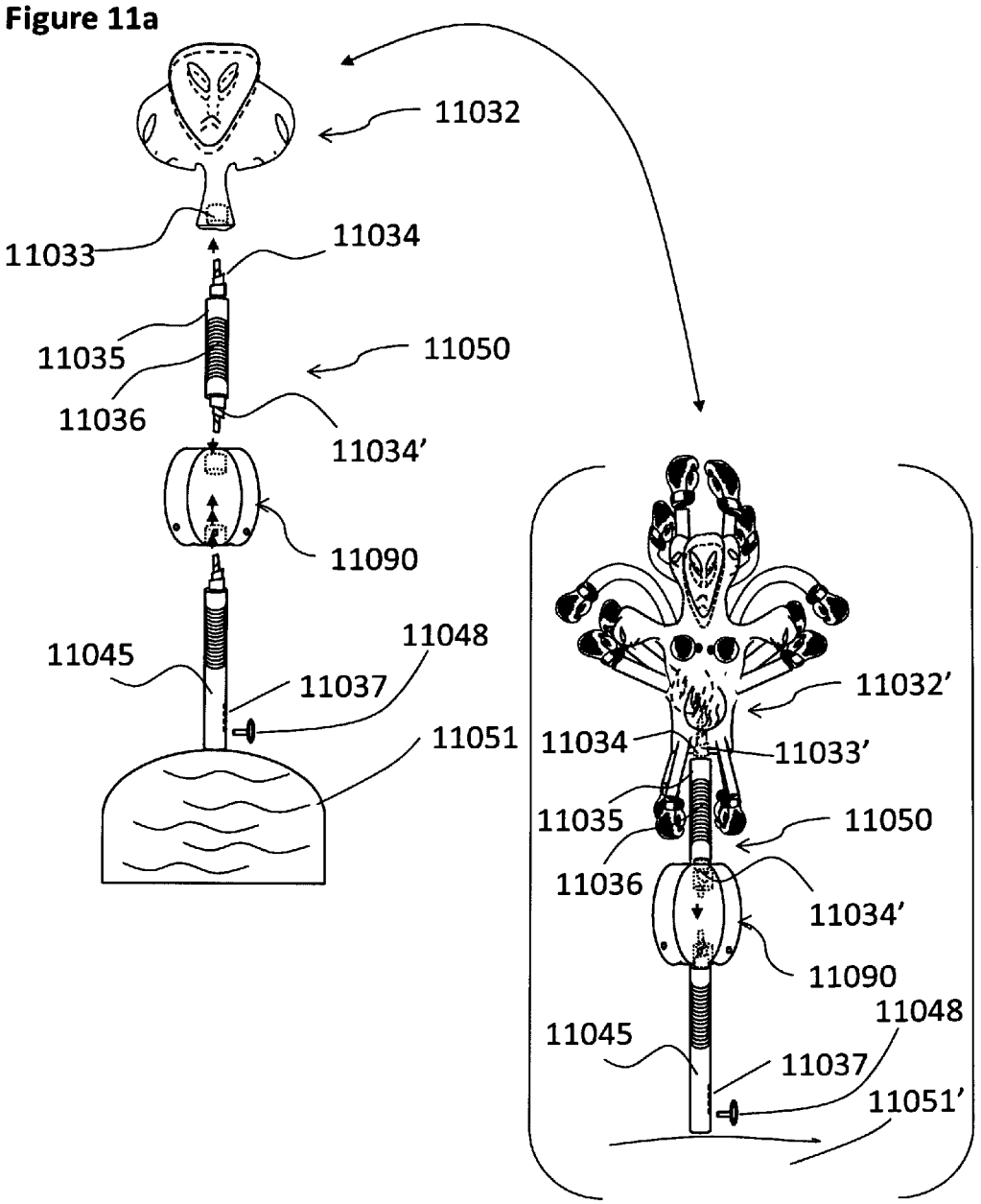
FIG. 11*a* illustrates a perspective view of the embodiment of the fight simulation apparatus of the subject invention where embodiments of interchangeable multi-head apparatuses are removed from the slip and counter machine and placed on a free standing apparatus as punching bag type structures (for example)
Figure 11B:
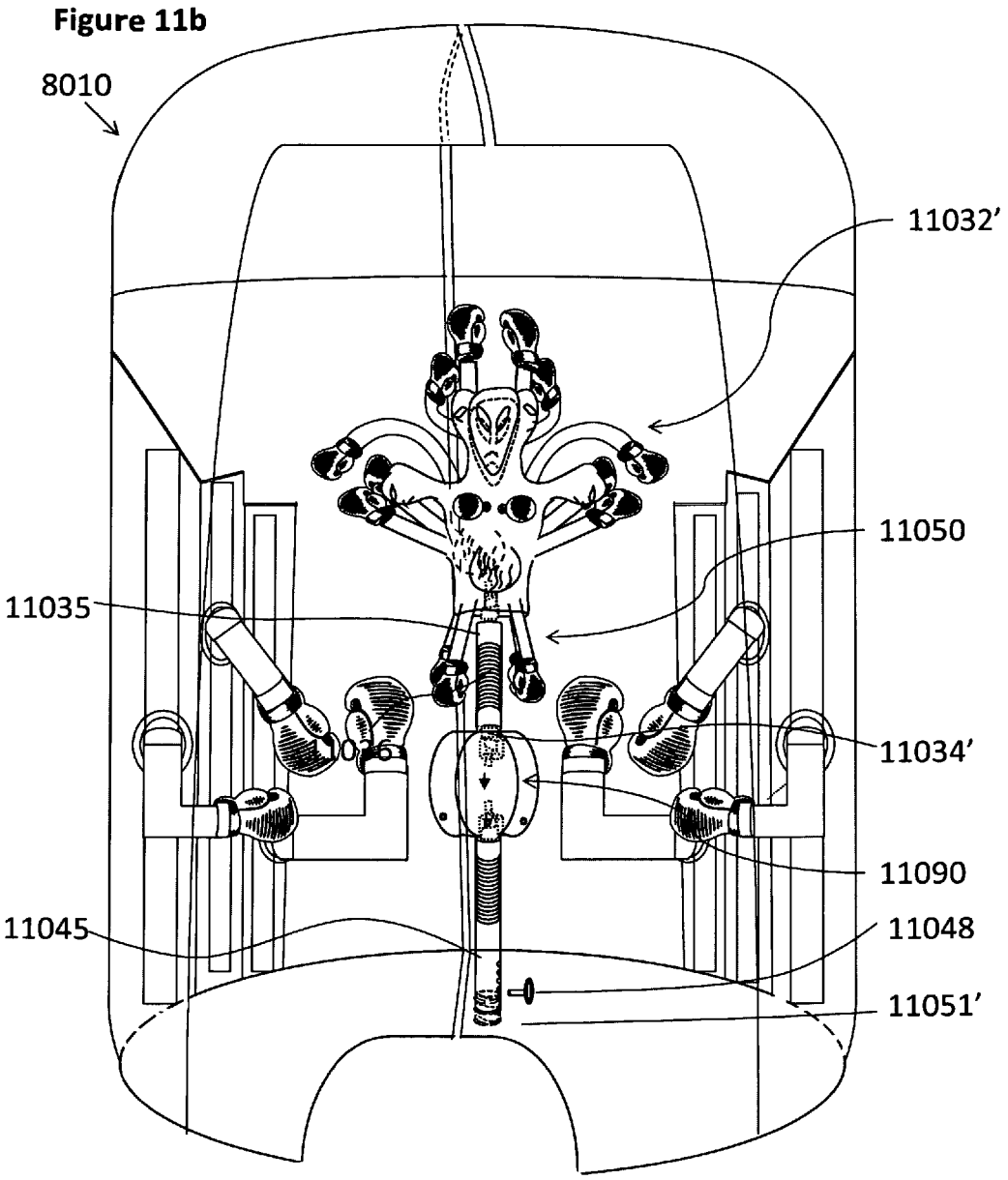
FIG. 11*b* illustrates a perspective view of the embodiment of FIG. 11*a* wherein one of the interchangeable multi-head apparatuses is positioned on the free standing apparatus and the free standing apparatus is placed within the slip and counter machine as a free standing punching bag type structure (for example) therein.

FIG. 11*a* illustrates a perspective view of the embodiment of the fight simulation apparatus of the subject invention where embodiments of interchangeable multi-head apparatuses 11032, 11032' are removed from the slip and counter machine and placed on a free standing apparatus 11050. FIG. 11*b* illustrates a perspective view of the embodiment of FIG. 11*a* wherein one of the interchangeable multi-head apparatuses 11032' is positioned on the free standing apparatus and placed within the slip and counter machine as a punching bag type structure (for example) therein. Referring to FIGS. 11*a* and 11*b*, multi-arm apparatus 11032, 11032' include a bottom threaded aperture 11033, 11033' adapted to receive a first threaded member 11034 located on a first strong flexible spring rod 11035 preferably having a spring member 11036 integrated therein. First strong flexible spring rod 11035 includes a second threaded member 11034' adapted to be attached to the base of the device 11051, 11051' (base of the slip and counter 11050 of FIG. 11*b*) or to another interchangeable part, herein shown as a 4-sided portly abdomen 11090. A second strong flexible spring rod 11045 is then attached to the underside of the 4-sided portly abdomen 11090 in the same manner as the first rod 11035. The bottom of the second rod 11045 is in turn attached to base 11051, 11051'. Height adjustable holes 11037 are provided for adjusting the height of rod 11045 and for insertion of a knob 11048 for securing to a base 11051, 11051' which may be filled with sand or water via base 11051 of FIG. 11*a*, or provided as an otherwise heavy base, or comprise the base 11051' of the slip and counter 11050 as shown in FIG. 11*b*, to prevent the apparatus from tipping or falling over.

FIG. 12 illustrates a perspective view of the embodiment of the fight simulation apparatus of the subject invention where a multi-head apparatus being a single head interchangeable part is removed from the slip and counter machine and placed on an adjustable free standing apparatus and is discussed hereinabove.

Figure 13:
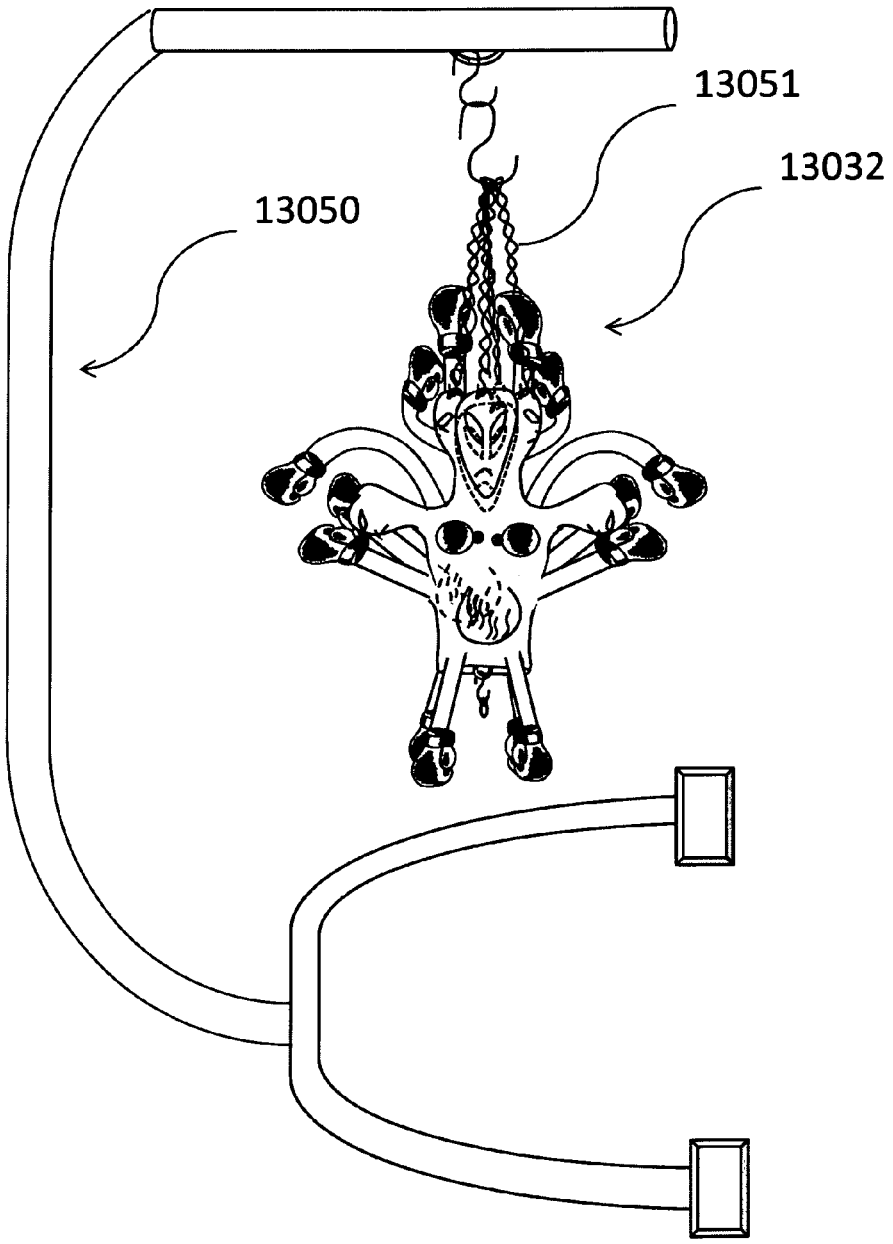
FIG. 13 illustrates a perspective view of the embodiment of the fight simulation apparatus of the subject invention where the multi-head, multi-abdomen, and multi-arm apparatus is removed from the slip and counter machine and placed on a free standing apparatus as a punching bag type structure (for example).

FIG. 13 illustrates a perspective view of the embodiment of the fight simulation apparatus of the subject invention where the multi-head, multi-abdomen, and multi-arm apparatus 13032 is removed from the slip and counter machine and placed on a free standing apparatus 13050. Bungee cords 13051 are utilized to secure the apparatus 13032 to the free standing apparatus 13050.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A fight simulation multi-headed, multi-abdomen, multi-armed apparatus comprising:

a. a multi-headed member having at least two heads, at least two abdomens, and eight sets of arms;

b. said multi-headed member further comprising a top u-shaped portion and a bottom u-shaped portion, said top u-shaped portion and said bottom u-shaped portion being adapted to receive an s-hook portion; and c. pillow soft, glove shaped washable cushions for eight sets of arms;

wherein said at least two heads and eight sets of arms are arranged to provide different punch configurations, so that said multi-headed member provides various angles adapted for a user to punch, knee, and/or do a flying knee, wherein each of said at least two heads comprises one arm of the eight sets of arms located thereon and extending therefrom.

2. A fight simulation multi-headed, multi-abdomen, multi-armed apparatus as recited by claim 1, wherein said multi-headed member comprises at least four heads.

3. A fight simulation multi-headed, multi-abdomen, multi-armed apparatus as recited by claim 1, wherein at least one head of the at least two heads is arranged in an orientation including facing upwards, downwards or to a side to provide for punches and knee kicks.

4. A fight simulation multi-headed, multi-abdomen, multi-armed apparatus as recited by claim 1, wherein said eight sets of arms each has a glove appending member.

5. A fight simulation multi-headed, multi-abdomen, multi-armed apparatus as recited by claim 1, further comprising said multi-headed member having at least one neck and at least one chest, and wherein said eight sets of arms have configurations that are arranged differently from one another so that said eight sets of arms provide different arrangements for said user to punch, each arm of said eight sets of arms being arranged to extend from or come out of a respective abdomen, chest, head, or neck of the apparatus and being arranged to protect a chin on said head and/or arranged in overhead, straight or hook positions.

6. A fight simulation multi-headed, multi-abdomen, multi-armed apparatus as recited by claim 5, wherein said eight sets of arms are located at different height levels on said apparatus and wherein at least one arm is shorter or angled differently with respect to at least one other arm to provide varying punch configurations.

7. A fight simulation multi-headed, multi-abdomen, multi-armed apparatus as recited by claim 1, wherein said at least two heads are arranged in positions from upright to facing the ground adapted for different strikes by a user.

8. A fight simulation multi-headed, multi-abdomen, multi-armed apparatus as recited by claim 1, wherein said multi-headed member includes an elongated neck terminating at one of said at least two heads and on an opposing side terminating at one of said at least two abdomens.

9. A fight simulation multi-headed, multi-abdomen, multi-armed apparatus as recited by claim 1, wherein said at least eight sets of arms extend in varied boxing positions, including extending overhand, straight out, or in hook positions.

10. A fight simulation multi-headed, multi-abdomen, multi-armed apparatus as recited by claim 1, wherein said multi-headed member comprises eight heads.

11. A fight simulation multi-headed, multi-abdomen, multi-armed apparatus as recited by claim 1, further comprising spring poles and bungee cords adapted to provide for various heights and placement of said multi-headed member.

12. A fight simulation multi-headed, multi-abdomen, multi-armed apparatus as recited by claim 1, further comprising a 4-sided portly abdomen.

13. A fight simulation multi-headed, multi-abdomen, multi-armed apparatus comprising:

a. a multi-headed member having at least four heads, at least two abdomens, and eight sets of arms;

b. said multi-headed member further comprising a top u-shaped portion and a bottom u-shaped portion, said top u-shaped portion and said bottom u-shaped portion being adapted to receive an s-hook portion; and c. pillow soft, glove shaped washable cushions for said arms;

wherein said at least four heads and said right sets of arms are arranged to provide different punch configurations, so that said multi-headed member provides various angles adapted for a user to punch, knee, and/or do a flying knee, wherein each of said at least four heads comprises one arm of the eight sets of arms located thereon and extending therefrom.

* * * * *